US010227162B2

(12) United States Patent
Davis et al.

(10) Patent No.: US 10,227,162 B2
(45) Date of Patent: Mar. 12, 2019

(54) STACKABLE AND COLLAPSIBLE CRATE

(71) Applicant: Clark Evan Davis, Genola, UT (US)

(72) Inventors: Clark Evan Davis, Provo, UT (US); Paul Schmidt, Provo, UT (US); Damian Pacheco, Provo, UT (US)

( * ) Notice: Subject to any disclaimer, the term of this patent is extended or adjusted under 35 U.S.C. 154(b) by 0 days.

(21) Appl. No.: 15/272,094

(22) Filed: Sep. 21, 2016

(65) Prior Publication Data

US 2017/0079426 A1 Mar. 23, 2017

Related U.S. Application Data

(60) Provisional application No. 62/221,549, filed on Sep. 21, 2015.

(51) Int. Cl.

| | |
|---|---|
| ***A47B 47/00*** | (2006.01) |
| ***B65D 25/30*** | (2006.01) |
| ***B65D 21/02*** | (2006.01) |
| ***B65D 6/16*** | (2006.01) |
| ***B65D 6/26*** | (2006.01) |

(Continued)

(52) U.S. Cl.

CPC ..... *B65D 25/30* (2013.01); *A47B 47/0075* (2013.01); *A47B 47/042* (2013.01); *B65D 9/12* (2013.01); *B65D 9/24* (2013.01); *B65D 21/0212* (2013.01); *A47B 87/0276* (2013.01); *A47B 2220/09* (2013.01); *A47B 2230/0092* (2013.01)

(58) Field of Classification Search

CPC .. A47B 43/00; A47B 47/0075; A47B 47/0091
USPC ..... 312/111, 258; 16/225; 403/291; 160/231.1

See application file for complete search history.

(56) References Cited

U.S. PATENT DOCUMENTS

| | | | |
|---|---|---|---|
| 919,257 | A | 4/1909 | Seydewitz |
| 981,532 | A | 1/1911 | Cary |

(Continued)

FOREIGN PATENT DOCUMENTS

| | | |
|---|---|---|
| DE | 102007058662 | 6/2009 |
| GB | 2353080 | 2/2001 |

(Continued)

OTHER PUBLICATIONS

Celery Rocking Chair viewed at http://www.eroomservice.com/manufacturer/celery/ circa Dec. 3, 2011.

(Continued)

*Primary Examiner* — Matthew W Ing
(74) *Attorney, Agent, or Firm* — Pate Peterson PLLC; Brett Peterson

(57) ABSTRACT

A stackable wooden crate that can be assembled and disassembled without tools, and stored flat is provided. The crate may include: two sides with box joint tabs, two sides with matching box joint recesses, a bottom, and a lid. The sides may come together at box joints held together with strap binding that stretches tight when the sides are folded 90 degrees to each other. A modified strap binding on one corner of the box is held tight via a tensioner buckle. The bottom is held captive by the four sides. The lid rests between four tabs that extend upward out of all four sides. When the lid is removed, multiple crates can be stacked, the upper crate held in place by the lower crate's four tabs which interface with recesses on the bottom of the upper crate.

20 Claims, 21 Drawing Sheets

(51) Int. Cl.
*A47B 47/04* (2006.01)
*A47B 87/02* (2006.01)

(56) References Cited

U.S. PATENT DOCUMENTS 1,061,297 A 5/1913 Johnson
1,419,647 A 6/1922 Shepherdson
1,747,900 A 2/1930 Jenny
1,903,631 A 4/1933 Morrison
1,940,117 A 12/1933 Carpos
2,240,256 A 4/1941 Elmendorf
2,279,864 A 4/1942 Eide
2,334,912 A 11/1943 Eide
2,369,930 A 2/1945 Wagner
D144,730 S 5/1946 Perrault
2,418,731 A 4/1947 Seitz
2,479,086 A 8/1949 Silverman
2,481,671 A 9/1949 John et al.
2,486,987 A 11/1949 Scarlett
2,518,955 A 8/1950 Stelzer
2,534,413 A 12/1950 Cenis
2,551,071 A 5/1951 Tyncs
D164,552 S 9/1951 Curtis
2,595,002 A 4/1952 Schneider
2,602,012 A 7/1952 Doty
2,615,771 A 10/1952 Curtis
2,632,498 A 3/1953 Curtis
2,672,181 A 3/1954 Rose
2,677,491 A 5/1954 Burger
2,720,253 A 10/1955 Turner
2,745,591 A 5/1956 Holt
2,786,789 A 3/1957 Carlson
2,792,877 A 5/1957 West
2,825,101 A 3/1958 Rubsnstein
3,053,598 A 9/1962 Cheslow
3,149,880 A 9/1964 Steuer
3,186,027 A 6/1965 Merillat
3,262,405 A 7/1966 Sutton
3,300,245 A 1/1967 Rumble
D212,601 S 11/1968 Rubsnstein
3,527,497 A 9/1970 Self
3,547,491 A 12/1970 Bovasso
3,578,385 A 5/1971 Stiglitz
3,603,656 A 9/1971 Ferman
3,697,363 A 10/1972 Martinez
3,788,700 A 1/1974 Wartes
3,812,977 A 5/1974 Glassman
3,847,435 A 11/1974 Skinner
4,055,924 A 11/1977 Beaver
D247,596 S 3/1978 Osamu
4,082,356 A 4/1978 Johnson
4,103,818 A 8/1978 Raubenheimer
4,140,065 A 2/1979 Chacon
4,153,311 A 5/1979 Takhasaki
4,158,277 A 6/1979 Krempp et al.
4,188,067 A 2/1980 Elmer
4,191,113 A 3/1980 Hogberg
4,202,581 A 5/1980 Fleishman
4,225,180 A 9/1980 Gillis
4,348,052 A 9/1982 Roland
4,390,204 A 6/1983 Fleishman
4,419,028 A 12/1983 Roland
4,433,753 A 2/1984 Watson
4,433,843 A 2/1984 Bricco
4,492,332 A 1/1985 Collins
4,509,794 A 4/1985 Roland
4,533,174 A 8/1985 Fleishman
4,544,092 A 10/1985 Palmer
4,548,350 A 10/1985 Engle
4,574,917 A 3/1986 Stoddard
4,591,090 A 5/1986 Collins
4,593,950 A 6/1986 Vittorio
4,595,105 A 6/1986 Gold
D289,234 S 4/1987 Hoult
4,685,609 A 8/1987 Ferrari
4,712,837 A 12/1987 Swilley
4,759,449 A 7/1988 Gold
D299,087 S 12/1988 Bruce
4,841,878 A 6/1989 Kriegsman
D302,216 S 7/1989 Roland
4,846,530 A 7/1989 Noble
4,867,327 A 9/1989 Roland
4,878,439 A 11/1989 Samson
4,926,759 A 5/1990 Vitsky et al.
5,011,228 A 4/1991 Marcantel
5,069,144 A * 12/1991 Williford ..... A47B 3/00 108/115
5,082,329 A 1/1992 Mars
5,253,595 A 10/1993 Heidmann
5,263,766 A 11/1993 McCullough
5,275,467 A 1/1994 Kawecki
5,354,589 A * 10/1994 Wass ..... E05D 1/02 160/231.1
5,367,964 A 11/1994 Hockensmith
5,387,027 A 2/1995 Maloney
5,454,331 A 10/1995 Green
5,605,378 A 2/1997 Oyediran
5,644,995 A 7/1997 Gurwell et al.
5,655,812 A 8/1997 Albecker
5,765,922 A 6/1998 Hsia
5,803,548 A 9/1998 Battle
5,921,631 A 7/1999 Bh
5,927,816 A 7/1999 Hsu
5,941,377 A 8/1999 Hart
5,992,938 A 11/1999 Jones
6,036,270 A 3/2000 Bufalini
6,041,920 A 3/2000 Hart
D422,799 S 4/2000 Dworshak et al.
6,053,585 A 4/2000 Osen
6,109,695 A 8/2000 Kahwaji
6,126,022 A 10/2000 Merkel
6,155,641 A 12/2000 Frost
6,174,116 B1 1/2001 Brand
6,189,974 B1 2/2001 Beck
6,247,754 B1 6/2001 Vanderaue et al.
6,283,564 B1 9/2001 Corson
6,347,772 B1 2/2002 L'Hotel
6,378,707 B1 4/2002 Taggert
6,443,076 B1 9/2002 Case
6,532,878 B2 3/2003 Tidemann
6,595,378 B2 7/2003 Wang
6,615,746 B2 9/2003 Bart
6,615,999 B1 9/2003 Culp
6,619,749 B2 9/2003 Willy
6,675,979 B2 1/2004 Taylor
6,769,369 B1 8/2004 Brandenberg
6,807,912 B2 10/2004 Willy
D499,577 S 12/2004 Willy
6,845,871 B1 1/2005 Culp
6,848,747 B1 2/2005 Robinson
6,955,401 B1 10/2005 Shoulberg
7,066,548 B2 6/2006 Butler
7,114,300 B1 10/2006 Culp
7,168,766 B2 1/2007 Pelletier
7,219,962 B2 5/2007 Stone
D547,076 S 7/2007 Hughes et al.
7,255,403 B2 8/2007 Butler
7,300,110 B1 11/2007 Debien
7,533,940 B1 5/2009 Zook
7,631,605 B2 12/2009 Willy
7,856,772 B1 12/2010 Culp et al.
8,167,377 B2 5/2012 Kovach
8,220,399 B2 7/2012 Berent et al.
8,332,917 B2 12/2012 Forster et al.
8,590,976 B2 11/2013 Davis
2003/0107255 A1 6/2003 Willy
2004/0056526 A1 3/2004 Willy
2008/0074013 A1 3/2008 Ahlgrim et al.
2009/0066140 A1 3/2009 Berent et al.
2010/0003077 A1 1/2010 Kelley
2012/0080910 A1 4/2012 Davis
2013/0062294 A1* 3/2013 Beaty ..... A47F 5/11 211/59.2

(56) References Cited

U.S. PATENT DOCUMENTS

| | | | |
|---|---|---|---|
| 2013/0080286 | A1 | 3/2013 | Rotholz |
| 2013/0170904 | A1 | 7/2013 | Cappelle |
| 2014/0263130 | A1 | 9/2014 | Davis |

FOREIGN PATENT DOCUMENTS

| | | |
|---|---|---|
| NL | 1025719 | 9/2005 |
| WO | WO 2005-085656 | 9/2005 |

OTHER PUBLICATIONS

PlyGrid Shelves viewed at http://offi.com/products/offikids/PLYGRID.php?p2c=249 circa Dec. 3, 2011.
Snap Table viewed at http://www.offi.com/pdfs/snaptable.pdf circa Dec. 3, 2011.
Furniture viewed at http://www.playatech.com/product_list.php circa Dec. 3, 2011.
Arabic Table viewed at http://www.plydea.com/support/assemblypdf.html circa Dec. 3, 2011.
Blue7Chair viewed at http://www.plydea.com/support/assemblypdf.html circa Dec. 3, 2011.
First Desk viewed at http://www.plydea.com/support/assemblypdf.html circa Dec. 3, 2011.
Rinaldo Chair viewed at http://www.plydea.com/support/assemblypdf.html circa Dec. 3, 2011.
Tuffet Stool viewed at http://www.plydea.com/support/assemblypdf.html circa Dec. 3, 2011.
WasteNot Basket viewed at http://www.plydea.com/support/assemblypdf.html circa Dec. 3, 2011.
Winehold Wine Rack viewed at http://www.plydea.com/support/assemblypdf.html circa Dec. 3, 2011.

* cited by examiner

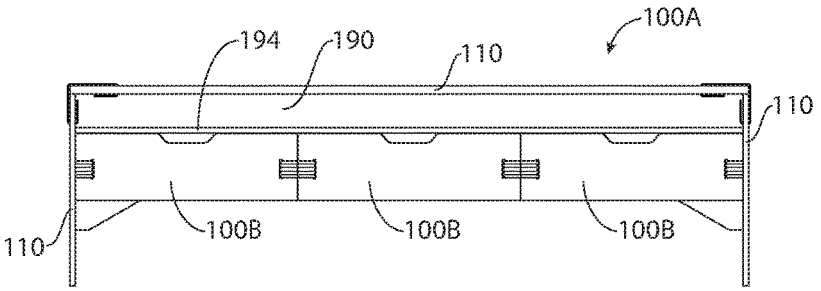
FIG 22a
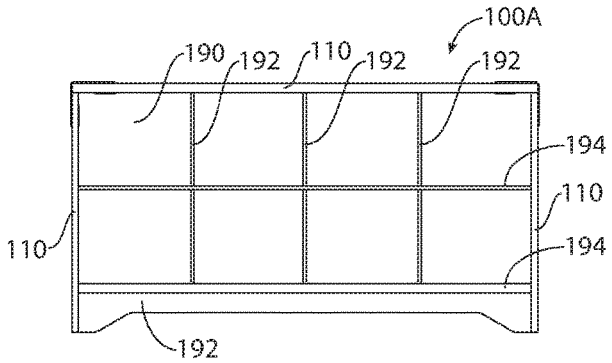
FIG 22b
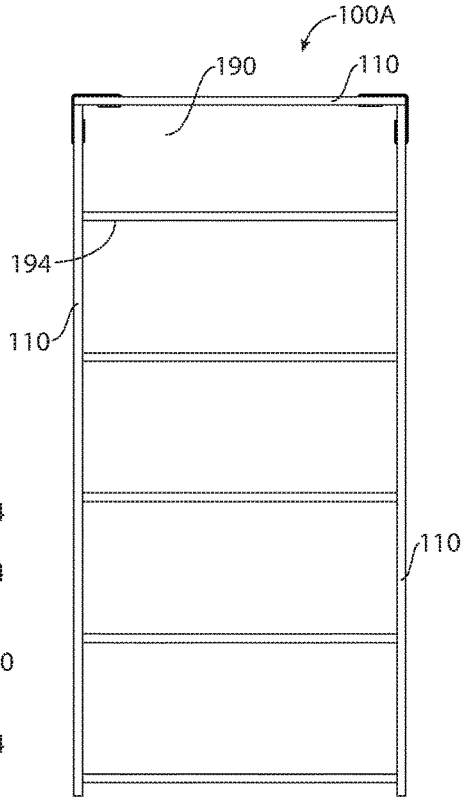
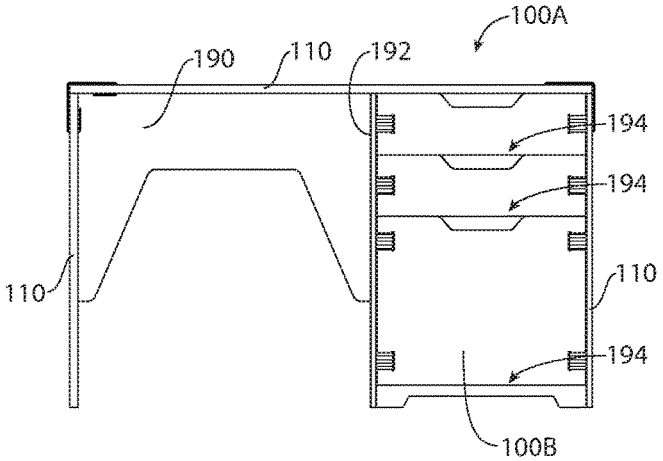
FIG 22c
FIG 22d

STACKABLE AND COLLAPSIBLE CRATE

PRIORITY

The present application claims the benefit of U.S. Provisional Application Ser. No. 62/221,549, filed Sep. 21, 2015, which is herein incorporated by reference in its entirety.

THE FIELD OF THE INVENTION

The present invention relates to modular furniture. In particular, examples of the present invention relates to a stackable and collapsible furniture crate.

BACKGROUND

Many persons desire modular furniture. Furniture which may be disassembled or collapsed is convenient as it may be reduced to a form which requires dramatically less volume. These items may be stored or transported much more conveniently due to the reduced space requirements. It is desirable to have modular furniture which is assembled with minimal tools. It remains a challenge to produce modular furniture which is stable and strong and which is still easily assembled.

BRIEF DESCRIPTION OF THE DRAWINGS

Non-limiting and non-exhaustive examples of the present invention are described with reference to the following figures, wherein like reference numerals refer to like parts throughout the various views unless otherwise specified.

FIGS. 21*a* through 22*e* show how the crate may be modified to create other items of furniture.

Figure 1:
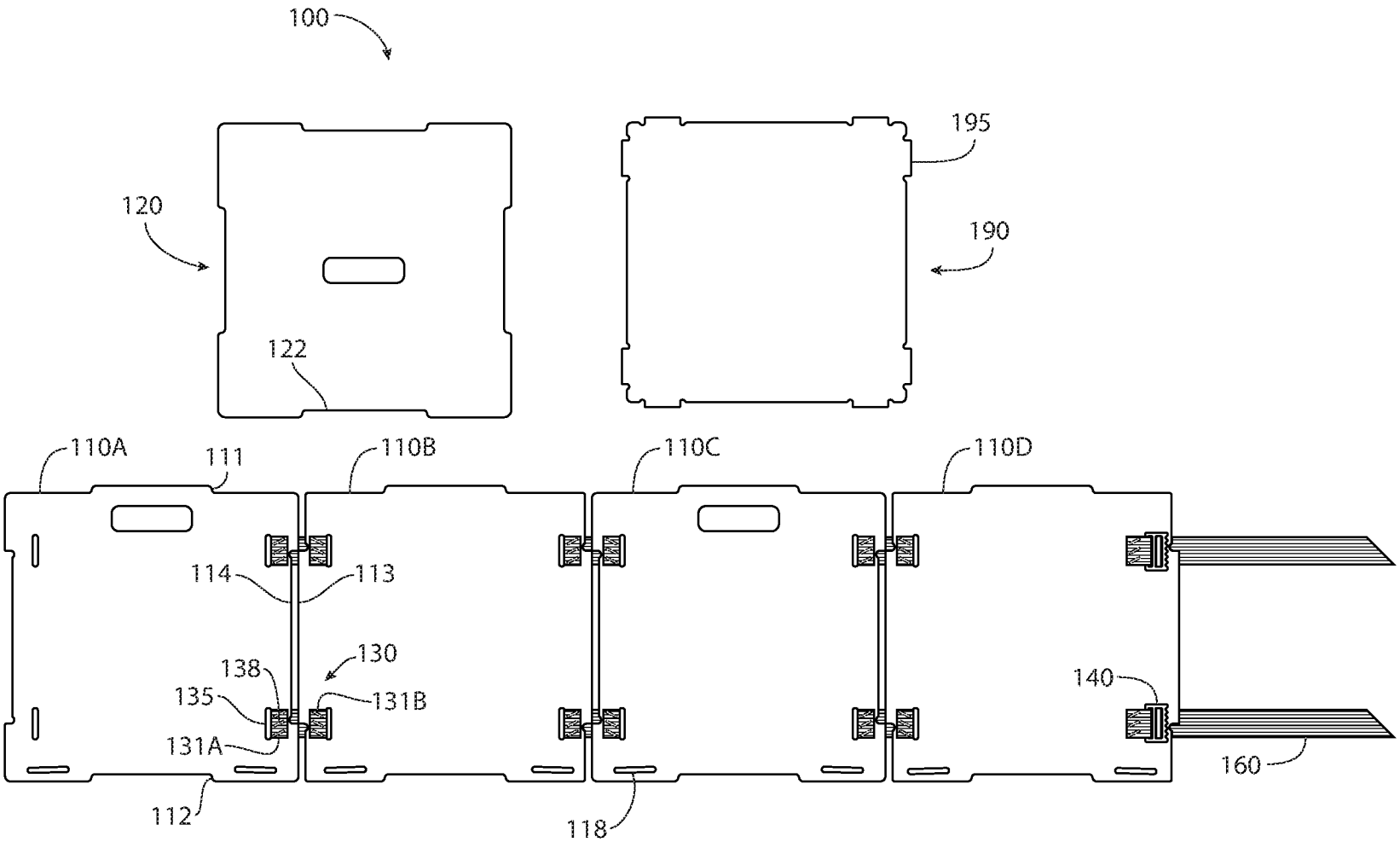
FIGS. 1 through 6 are drawings showing a stackable furniture crate having a modular furniture corner joint of the present invention.

Corresponding reference characters indicate corresponding components throughout the several views of the drawings. Skilled artisans will appreciate that elements in the figures are illustrated for simplicity and clarity. The drawings have been drawn to scale to better illustrate the embodiments of the invention. Also, common but well-understood elements that are useful or necessary in a commercially feasible embodiment are often not depicted in order to facilitate a less obstructed view of these various embodiments of the present invention.

It will be appreciated that the drawings are illustrative and not limiting of the scope of the invention which is defined by the appended claims. The examples shown each accomplish various different advantages. It is appreciated that it is not possible to clearly show each element or advantage in a single figure, and as such, multiple figures are presented to separately illustrate the various details of the examples in greater clarity. Similarly, not every example need accomplish all advantages of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

In the above disclosure, reference has been made to the accompanying drawings, which form a part hereof, and in which is shown by way of illustration specific implementations in which the disclosure may be practiced. It is understood that other implementations may be utilized and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, such feature, structure, or characteristic may be used in connection with other embodiments whether or not explicitly described. The particular features, structures or characteristics may be combined in any suitable combination and/or sub-combinations in one or more embodiments or examples. It is appreciated that the figures provided herewith are for explanation purposes to persons ordinarily skilled in the art and that the drawings are not necessarily drawn to scale.

The disclosure particularly describes modular furniture. Particularly, the present disclosure describes a joint structure for modular furniture. The joint may be used on different items of furniture including crates, drawers, shelving units, etc. The joint includes two intersecting panels and a tensioning strap. The panels are often disposed at right angles to each other and form a corner of an item of furniture. The panels may include complementary tabs and recesses on edges of the panels. These tabs and recesses engage each other and locate the two panels with respect to each other. The tension strap is attached to both panels. The tensioning strap extends across the intersecting edges of the panels on the side of the panels which forms the outside of the joint. In an open, flat configuration of the panels, the tensioning strap is loose and allows movement of the panels. When the panels are positioned in an assembled configuration to complete the joint and form the item of furniture, the tensioning strap is held tight and may be stretched slightly to apply tension to the completed joint. The item of furniture may be assembled by moving panels with attached tensioning straps into position to form three joints of an item of furniture and using a non-attached binding strap to secure the fourth joint.

A stackable wooden crate 100 which has several distinctive features is described in detail below: The stackable crate 100 illustrates many aspects of the modular furniture joint and shows how the joint may be applied to other items of furniture such as a drawer, furniture case, shelving unit, etc. Various aspects of the modular furniture joint and item of furniture may include:

Stackable: A tab 111 extends upward out of each of the four sides 110 of the crate while a matching recess 112 is cut out of the bottom of each of the four sides 110, creating a interfacing structure which prevents forward/backward, sideways, and twisting movement of the top crate independent of the bottom crate when two crates are stacked.

Lid 120: A single-piece lid 120 has four recesses 122 that allow it to fit between the tabs 111 of an assembled crate, enclosing the contents of the crate. When the lid is on the crate, there is no longer an interfacing connection for any additional crate stacked on top. The four tabs create a loose box joint between the lid and the rest of the crate, creating a hinge edge 125 when the lid is opened from any of the opposite edges.

Box Joint 150: The four sides 110 come together in box joints 150. Sides 110B and 110D have the tab portion 113 of the joint, while sides 110A and 110C have the recess portion 114 of the joint. This box joint is not held together by adhesive, screws, nails, bolts, or pins. Instead, it is held together by strap joint 130 and adjustable binding clamp 170. It will be appreciated that the four sides 110 of a piece of furniture may each include one side with a tab portion and one opposing side with an indentation (recess) portion, allowing them to be placed sequentially around a piece of furniture so that each tabbed edge aligns with an recess edge. Alternatively, the piece of furniture may be formed with two sides 110 which each have two opposing edges with tab portions and two other sides 110 which each have two opposing edges with recess portions. These sides 110 may be arranged in an A B A B arrangement so that each tabbed edge aligns with a corresponding recess edge.

Strap joint 130: Three of the four box joints between sides 110 are held together by a strap joint 130. The end of a short length of strap 132 is firmly fastened to one side 110, while the other end of the strap is fastened to the neighboring side 110 at a specific level of tension. The distance that the strap is forced to travel from fastening location 131A to fastening location 131B increases when the sides are folded from being parallel to being perpendicular. The increase in distance is equal to the thickness of the side. This increase in distance stretches the strap 132 into a tensioned state, holding the joint firmly together. The strap 130 is typically made of a synthetic textile material such as nylon webbing, etc.

One embodiment has a total of six strap bindings 130, three of the four box joints 150 having both an upper and lower strap binding. One end of strap 132 is threaded through a slot 135 in the face of side 110, folded over towards the nearest outer edge of that side 110, and then fastened with staples 138. These strap bindings are located vertically so that they cover up the upper and lower edges of tab 113 and recess 114. With a piece of furniture having sides 110A, 110B, 110C, and 110D, the strap bindings are used between panels 110A-110B, 110B-110C, and 110C-110D.

Adjustable binding clamp 170: The remaining box joint between sides 110D and 110A has a modified strap binding. A longer length of strap 160 is threaded through a slot 135 and then threaded through the rear slot 142 of a tensioner buckle 140 (of the type commonly found on backpacks). The strap 160 is then fastened with staples 139 to the left side of slot 135, opposite the nearest outer edge of side 110D.

The long end of strap 160 is then wrapped around box joint 150, and through slot 135 of side 110A. Strap 160 is then threaded through buckle 140 and pulled tight.

Adjustable binding clamp 170 can be loosened and unthreaded by loosening the strap 160 and buckle 140, allowing the crate 100 to be assembled and disassembled many times, in order for it to be stored flat.

Flatpack Storage: The preferred embodiment of crate 100 can be disassembled and stored flat. Due to the looseness of the straps in Strap Bindings 130, the crate can be stored flat in the compact orientation shown in FIG. 11.

FIG. 1 shows a crate 100 made from strap joints. The crate 100 is used as an example configuration to illustrate the strap joints and structures of the present invention. The crate 100 is also fundamentally a 5 sided (and/or lidded) cabinet and the joints and general configuration of the cabinet may be used to form other pieces of furniture by changing the dimensions of the panels and rotating the cabinet. Internal dividers may be added to the cabinet to form shelves or storage spaces and other crates/cabinets may be used as shelves or storage boxes within a larger cabinet. Accordingly, the crate 100 is first presented as it forms the basis of the other pieces of furniture which may be constructed from the simple crate cabinet.

FIG. 1 shows the flat orientation of all the parts before assembly: the lid 120, the bottom 190, the sides 110, the six strap bindings 130, the two buckles 140, and the two longer straps 160. The crate 100 includes four side panels 110, with two strap joints 130 attaching adjacent panels. The side panels 110 are generally rigid and are often made of a sheet material such as plywood, particle board, plastic, etc. The side edges of the side panels 110 have tabs 113 and corresponding recesses 114. The tabs 113 particularly engage the recesses 114 on the sides of the tabs and recesses to keep the panels 110 aligned with each other along the length of the abutting side edges of the panels 110. This strengthens the resulting joint in shear and provides a sturdy construction. The tabs 113 and recesses 114 are cut so that the abutting edges of the tabs 113 and recesses 114 are covered by the strap 130 on the outside of the joint. While not necessary, this makes the joint more visually appealing and covers the corners and edges of the tabs and recesses. Covering the edges of the tab 113 and recess 114 with the strap 132 also makes the joint somewhat stiffer.

FIG. 1 shows the inside surfaces of the crate sides 110. Accordingly, the straps 132 extend across the sides of the side panels 110 on the outside surface of the panels 110. The ends of the straps 132 extend through slots 135 cut through the panels 110 so that the ends of the straps 132 are on the inside of the panels 110. The ends of the straps 132 are attached to the inside of the panels with staples or glue. It can be seen how there is a gap between adjacent side panels 110 when the panels are laid flat as shown. The strap 132 extending across the outside surfaces of the panels 110 is seen through the gap. The width of this gap is approximately equal to the thickness of the material used to form the panels 110, and the width of the gap between adjacent panels 110 is often slightly less than the thickness of the panel material. When the panels 110 are folded into a crate, the gap between panels is occupied by the edge of the panels 110 and the straps 132 are stretched tight. The straps thus apply some pressure to the panels and hold the panels against each other. This tightness of the straps stiffens the resulting joint and makes the item of furniture stronger and more appealing to a user.

Figure 2:
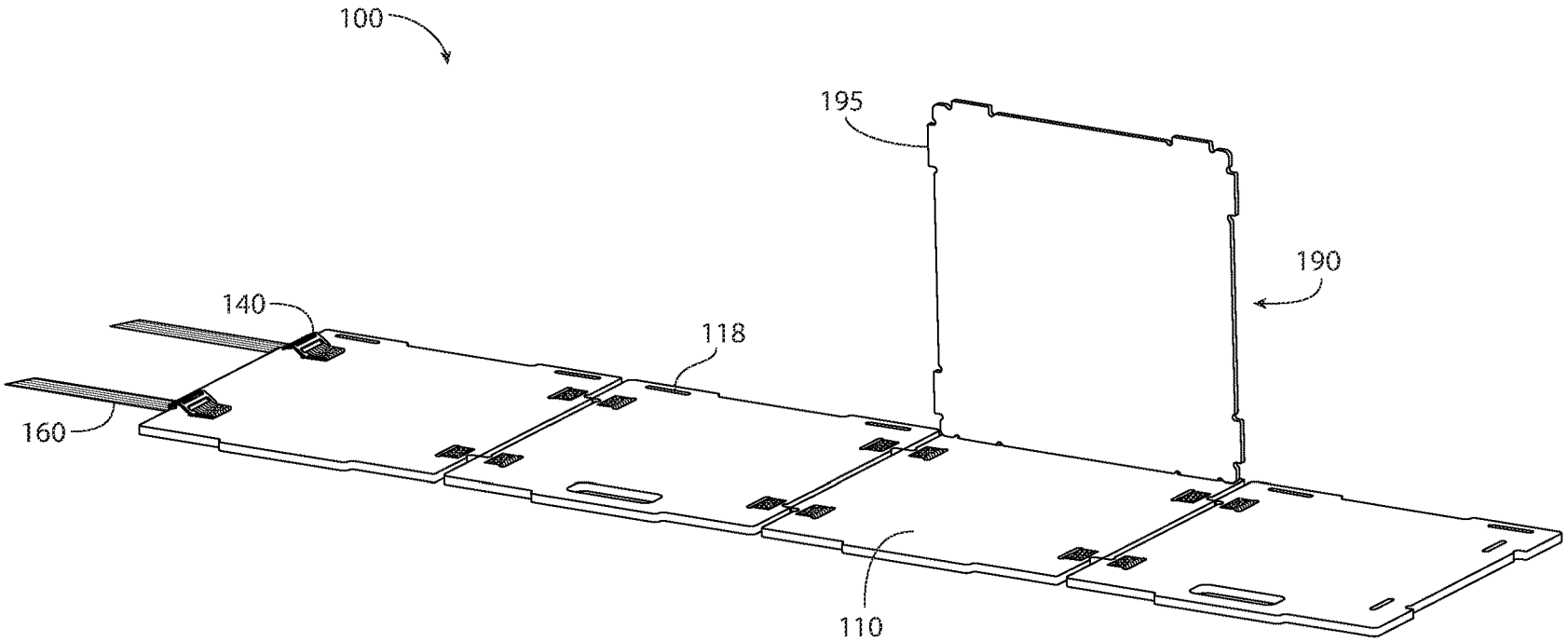

FIG. 2 is an isometric image of the first step of assembly of the crate 100. The tabs 195 of bottom panel 190 fit into slots 118 in the side panels 110. The bottom panel tabs 195 and corresponding slots 118 may be full depth or may be partial depth to make the furniture more appealing.

Figure 3:
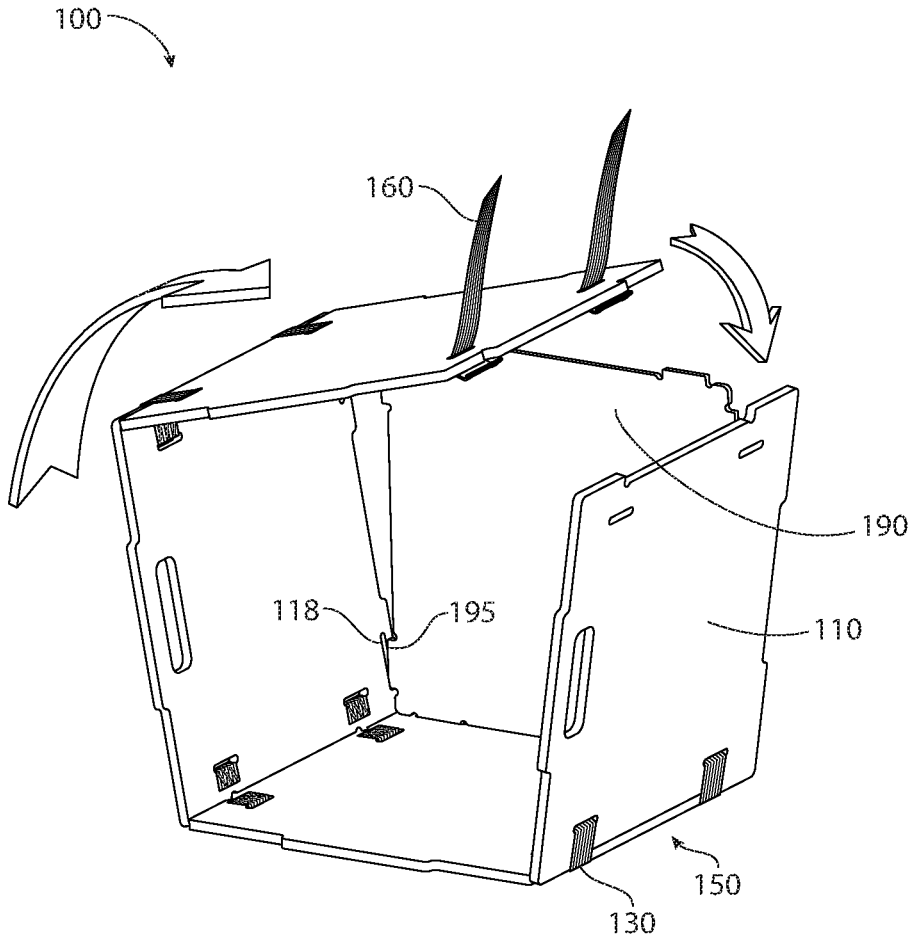

FIG. 3 is an isometric image of the second step of assembly of the crate 100. The sides 110 are folded up and around the bottom panel 190. The tabs 195 of the bottom panel 190 are placed into their associated slots 118 as subsequent side panels 110 are folded around the bottom panel. It can be seen how the straps 132 wrap around the outside of the corner joints 150 between side panels 110 and these strap joints tighten up around the box joints 150 which are formed. These attached straps 132 are placed around three of the four corners as the fourth corner needs to be open to allow the side panels 110 to be placed around the bottom panel 190 as shown. The fourth corner between side panels 110 may be secured by a strap clamp 160. The strap clamp 160 includes a length of strap material with a tensioning buckle attached to one end. The strap material is passed through a slot 135 in the panel 110. In one embodiment, the buckle is positioned on an inside surface of the panel 110 near the slot 135 and the strap adjacent the buckle is stapled or glued to the panel 110. The remaining length of strap material extends along the outside of the side panel 110. Once the sides 110 of the crate 100 are positioned around the bottom panel 190 the remaining length of strap material is passed through a corresponding slot 135 in the adjacent panel 110, inserted into the buckle, and tightened. This joint may be modified by placing the buckle on the outside of the panels 110 to minimize intrusion into the enclosed volume of the crate. The joint may also be modified by not securing the strap 160 to the panel 110 by glue or staples, as the buckle will secure the strap clamp 160 to the panels 110 once assembled.

Figure 4A:
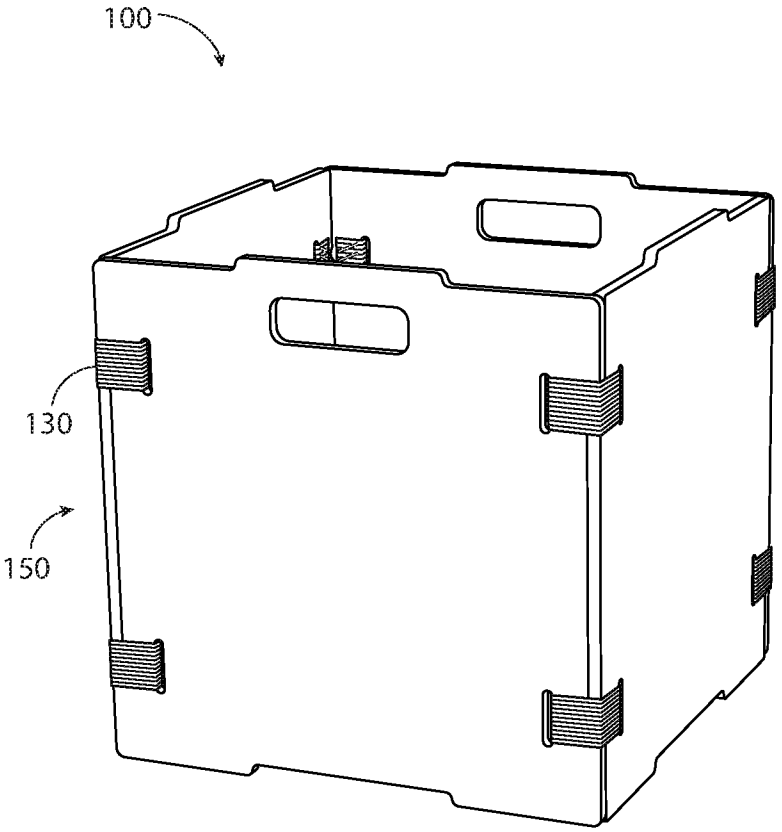

FIG. 4*a* is an isometric image of the assembled crate 100 without the lid 120 fitted into place. It can be seen how the upper edges of the side panels 110 may include tabs 111 to receive and index a lid and how two or more of the side panels 110 may include hand grip holes cut through the panels to allow a person to easily use and move the crate.

Figure 4B:
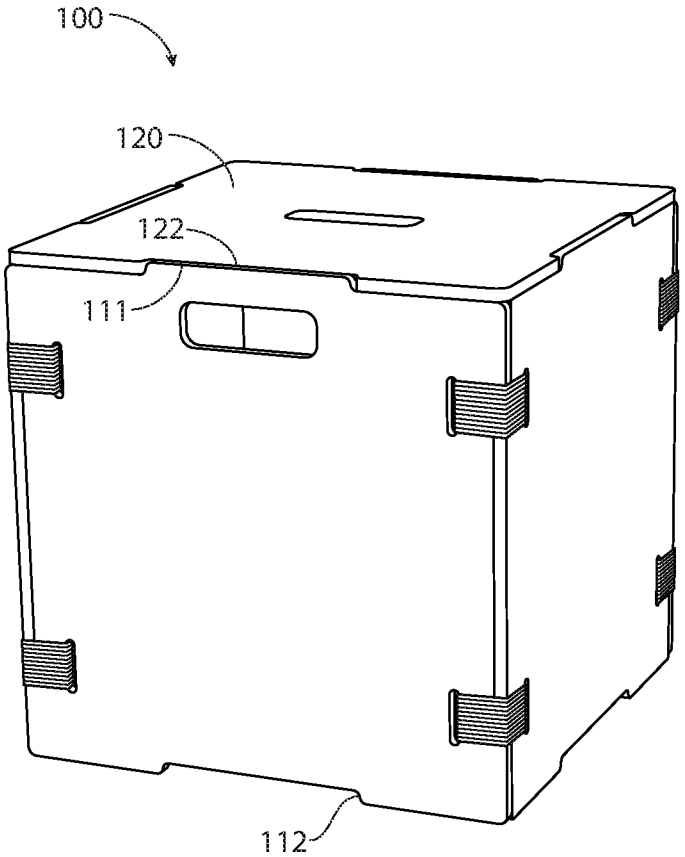

FIG. 4*b* is an isometric image of the assembled crate 100 with the lid 120 fitted into place on the side panels 110. The lid 120 includes recesses 122 which receive and engage the tabs 111 of side panels 110. When tabs 111 and recesses 122 are used on multiple axes, e.g. on four sides, the lid 120 is held in place and does not shift side to side.

Figure 5:
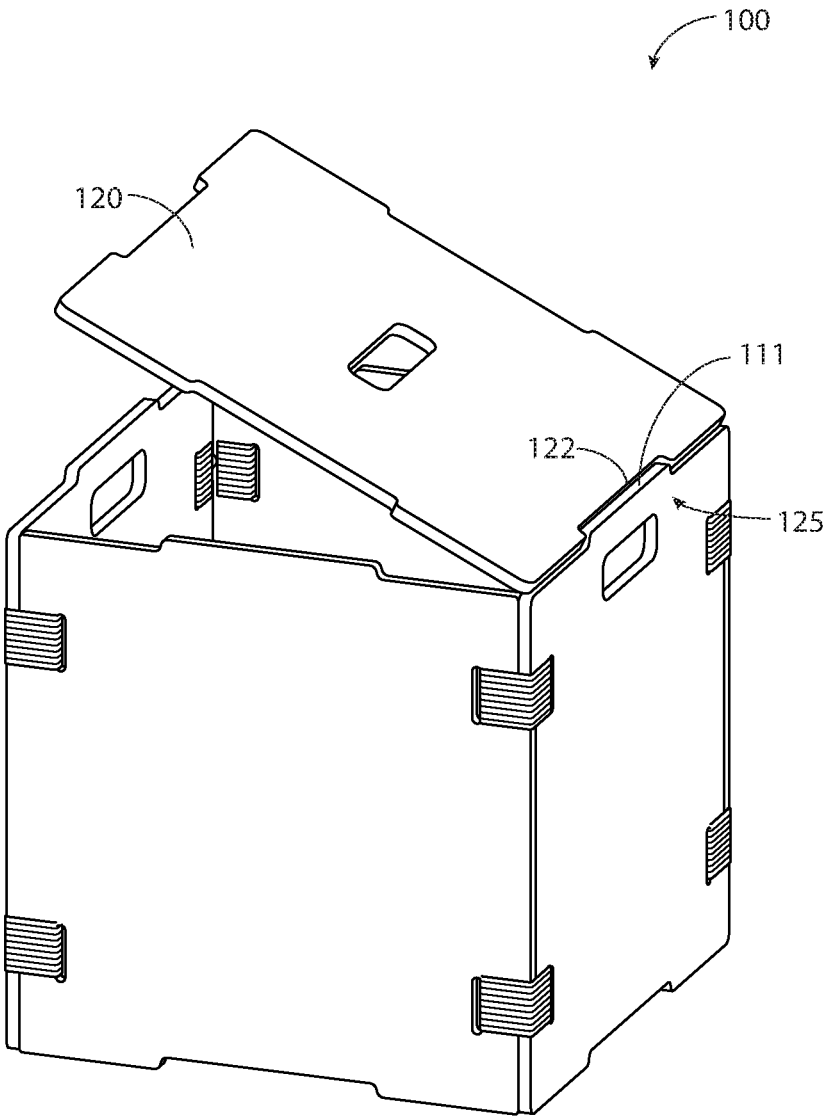

FIG. 5 is shows the assembled crate 100 with lid 120 angling up from a hinge edge 125 which is created from the loose box joint interaction between a tab 111 and a recess 122. It can be seen how the lid 120 may be pivotably opened from any side as shown or removed altogether from the crate.

Figure 6:
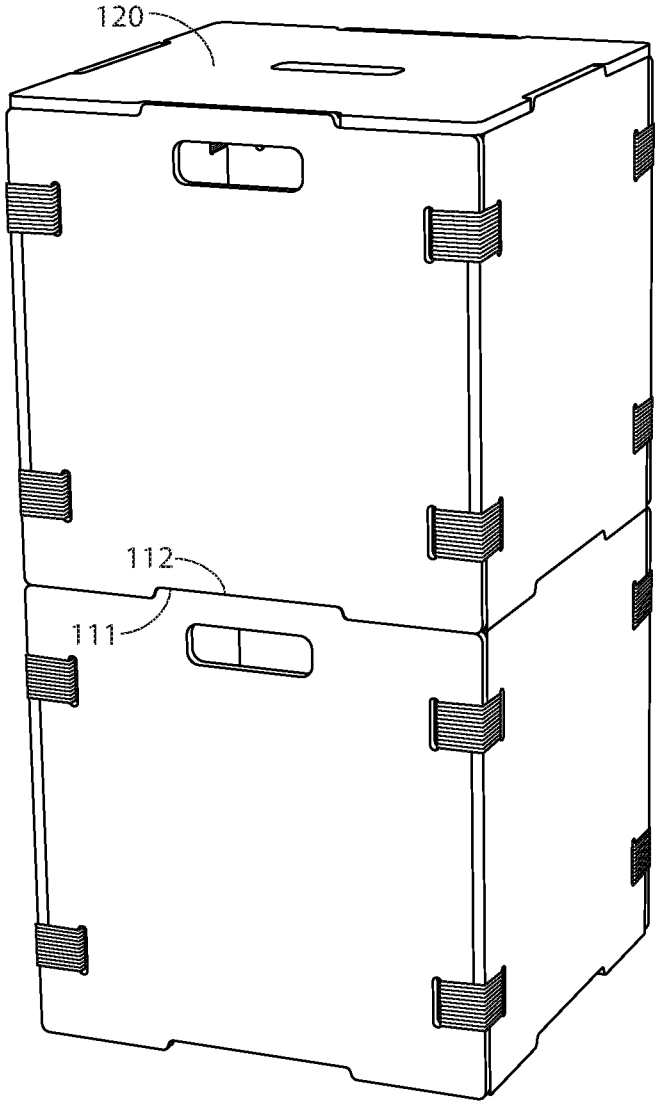

FIG. 6 is an isometric image of two assembled crates 100 which have been stacked. The upper crate has a lid 120, while the lower crate does not have a lid. The lower edges of the side panels 110 of the crates 100 include recesses 112 which are complementary in shape and which correspond to the tabs 111 formed in the upper edges of the crate sides 110. The upper crate thus interfaces with the lower crate; preventing the upper crate from having any forward, backward, sideways, or twisting movement independent of the lower crate.

It will be appreciated that modification of the basic crate design will allow different types of furniture to be made. For example, using the side panels 110 as side and bottom panels and using the bottom panel 190 as a back panel turns the crate into a storage cubby or shelf. Multiple of these cubbies may be stacked together to form a shelf unit. Additionally, the panels 110 used as vertical side panels may be elongate and one or more divider panels may be inserted between opposing panels 110 during assembly to form additional shelves or to form vertical dividers in the crate. The divider panels may include tabs on edges and may fit into slots formed in the panels 110 in a manner similar to how the bottom panel 190 is held between side panels. In this manner, the basic structure of the crate 100 may be modified to form a cabinet, shelf unit, drawer, storage cubby, etc.

Figure 7A:
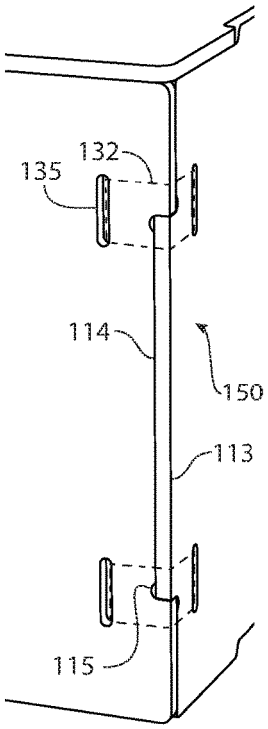
FIGS. 7*a* though 8*b* show details of the corner joint.
Figure 7B:
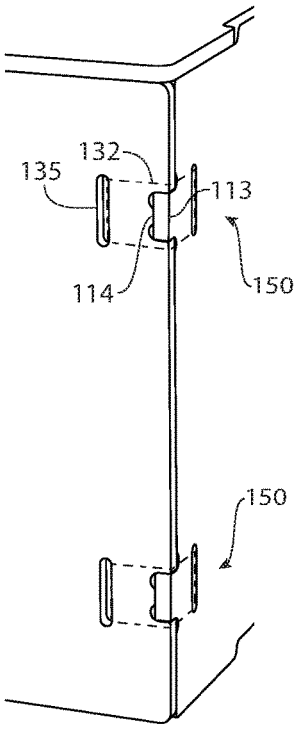
Figure 7C:
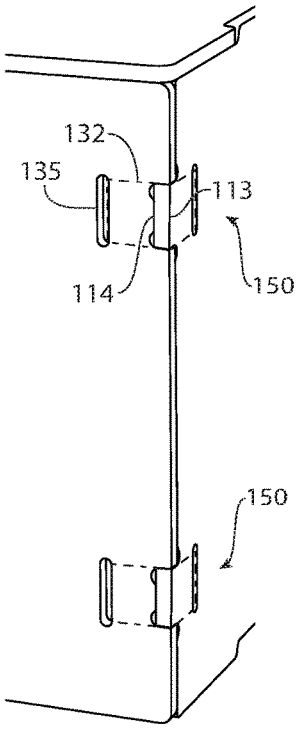

FIGS. 7*a* through 7*c* are partial isometric views of the crate 100. The straps 132 are shown transparent with the edges and location of a strap 132 indicated with a dotted line. This illustrates how the slots 135 are located vertically so that the straps 132 cover up the upper and lower edges of tab 113 and recess 114 on box joint 150. In addition, round-out 115 (the overcutting of an inside corner with a round bit so that a rectangular object fits completely into the corner) at the upper and lower edges of tab 113 and recess 114 is depicted. The preferred embodiment is cut out of flat material using a CNC router; therefore a round-out is required in order to make the tight 90 degree corner which is preferable for box joint 150. FIG. 7*a* shows how the corner joint 150 may use a single tab 113 and recesses 114.

FIG. 7*b* shows how the corner joint 150 may alternately use two smaller tabs 113 and recces 114 which may be completely hidden beneath the straps 132. This would be desirable for an application where only the front of the box would be visible and visible recesses 114 may not be desirable, such as where the furniture 100 is used as a drawer.

FIG. 7*c* shows how the corner joint 150 may use slightly larger tabs 113 and recesses 114 where the edges of the tabs and recesses are outside of or collinear with the top and bottom edges of straps 132. This embodiment is not ideal because the straps 132 would place reduced holding force on the side panel 110 which has recess 114 as no force is being transmitted directly at the corner. This may, however, be desired for visual appeal. It will also be appreciated that multiple tabs 113 and recesses 114 may be used to provide the visual appearance of a finger joint or other visual designs while achieving the advantages of the strap joint 150.

Figure 8A:
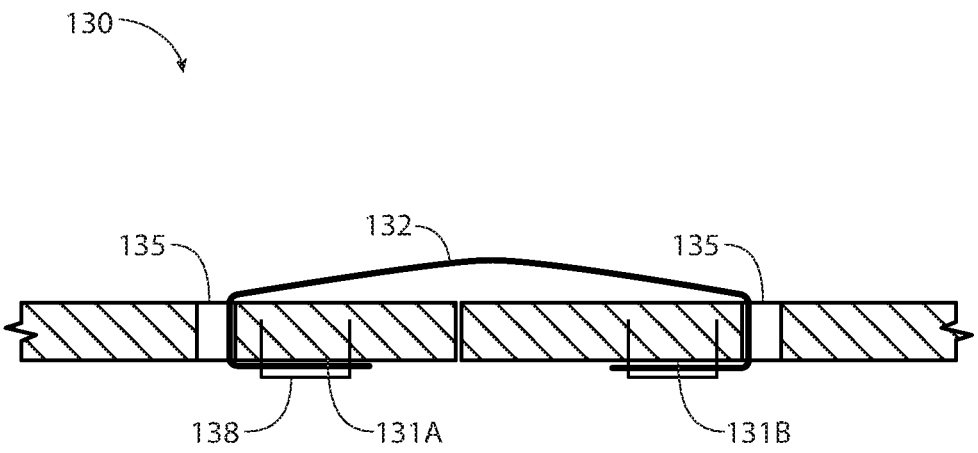
Figure 8B:
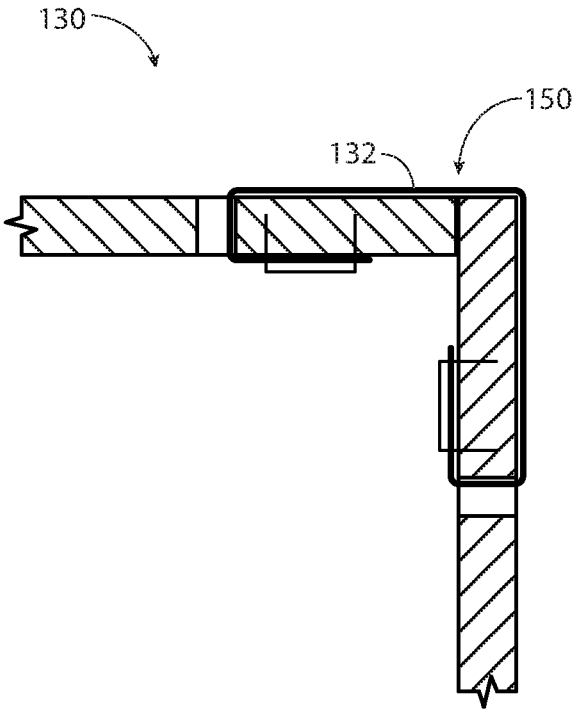

FIG. 8*a* shows an unassembled strap joint 130 and shows how the strap 132 of strap joint 130 is loose when the sides 110 are parallel. The panels 110 may be pulled away from each other to create a gap. Depending on the elasticity of the straps 132, the gap between panels 110 may be adjusted to provide an amount of stretch in the straps 132 and a desired tension in the assembled joint 130. FIG. 8*b* is a diagram showing how strap 132 of strap joint 130 is tightly tensioned when the sides 110 are folded 90 degrees to each other, creating box joint 150.

Figure 9A:
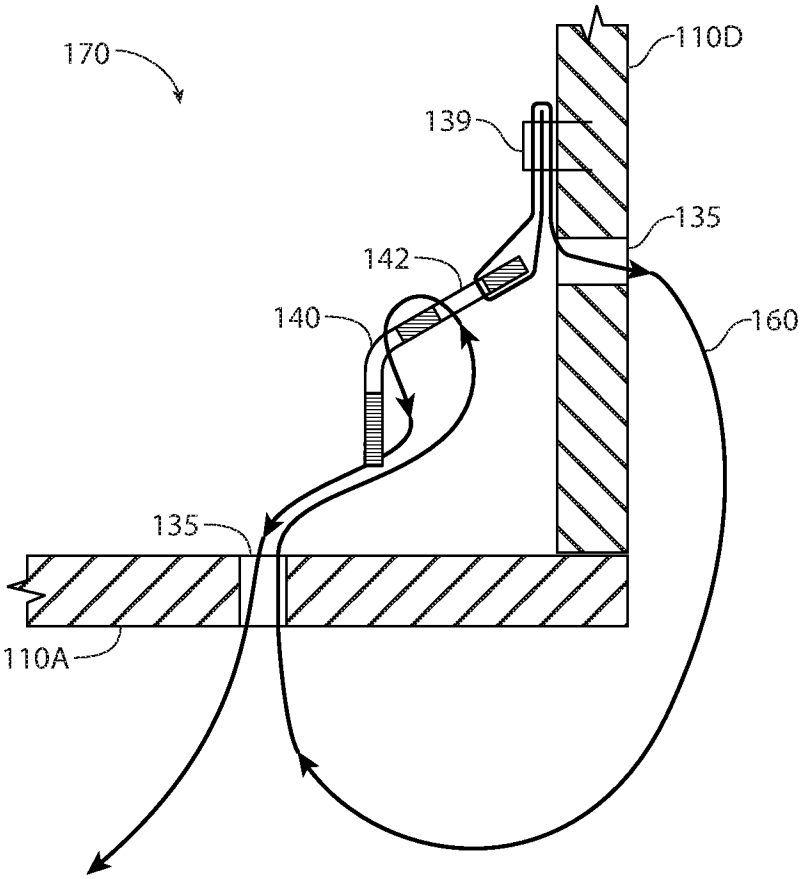
FIGS. 9*a* through 10 show the adjustable binding clamp.
Figure 9B:
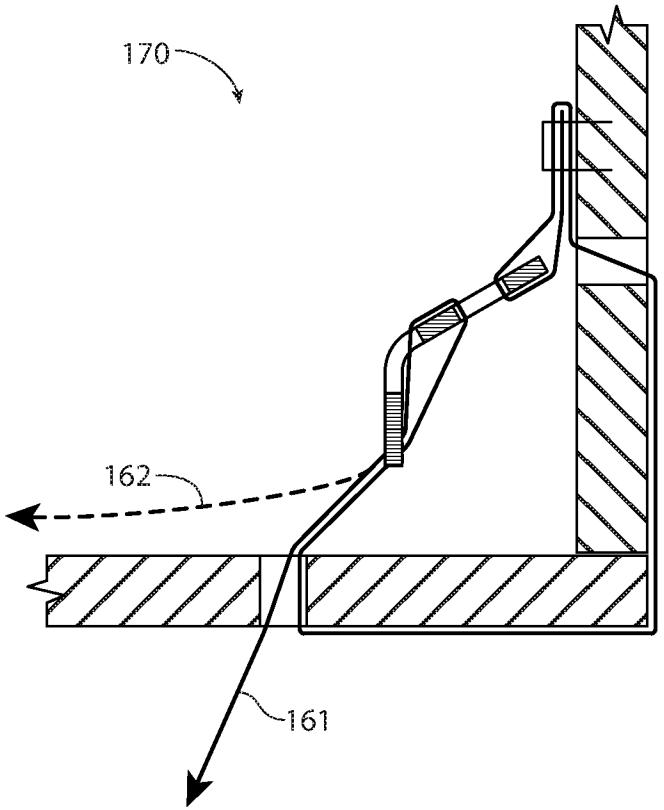

FIG. 9*a* is a diagram showing the orientation of the removable tightening strap 160 as it is fastened to side panel 110D. The arrows drawn onto strap 160 shows how it is attached to the buckle 140, passed through slots 135 around the outside of the panels 110, then back through buckle 140, respectively. FIG. 9*b* shows how the end of the strap 160 is passed through the slot 135 and is tightened as indicated at 161, and may be withdrawn back through the slot 135 to the inside of the crate after the strap 160 is tightened as shown at 162. The strap 160 and buckle 140 together make an adjustable binding clamp 170 which may be secured to assemble the furniture or released to disassemble the furniture.

Figure 10:
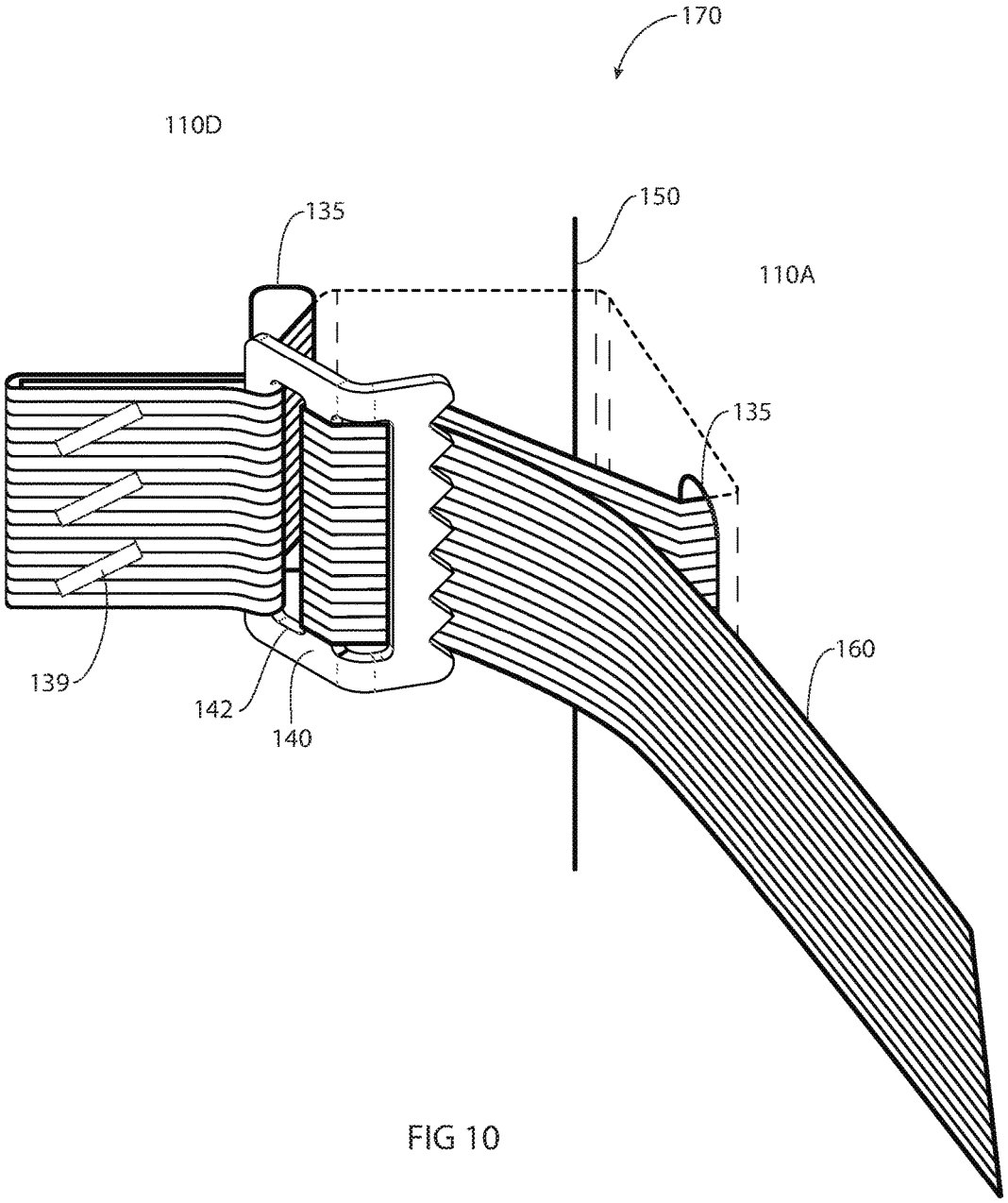

FIG. 10 is an isometric close up view of the adjustable binding clamp 170, showing the orientation of strap 160 as it is fastened to side 110D via staples 139, threaded through slot 142 of buckle 140 and slots 135, then back through buckle 140, respectively.

Figure 11:
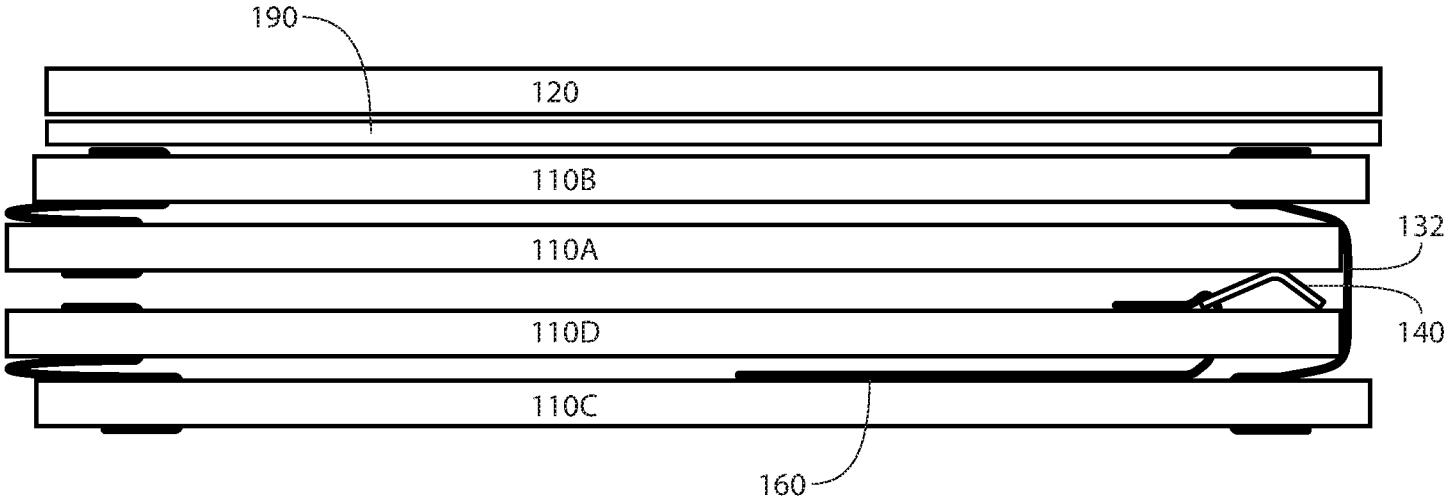
FIG. 11 shows the collapsed crate.

FIG. 11 is a side view of the crate 100 when disassembled and packed flat. With a crate where the sides 110 are all the same dimension, there is just enough room provided by the straps 132 to stack them on top of each other in the depicted orientation. In addition, the bottom 190 and lid 120 also are of the same length and width, fitting on top. Pieces of furniture where the side panels 110 are of different lengths can also pack flat.

Figure 12A:
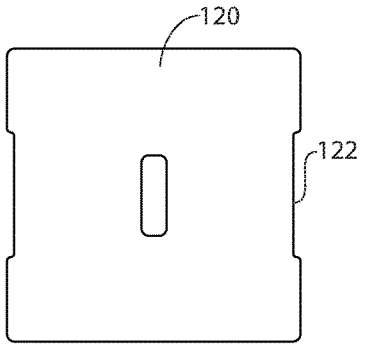
FIGS. 12*a* through 12*f* show the crate lid.
Figure 12B:
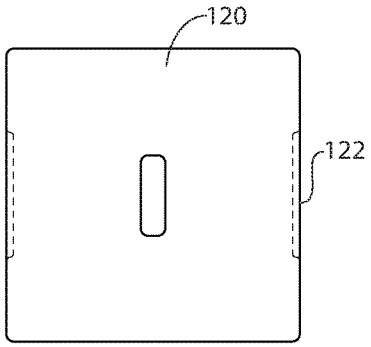
Figure 12C:
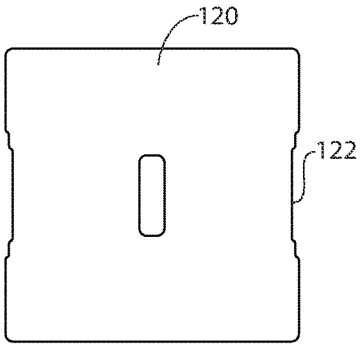
Figure 12D:
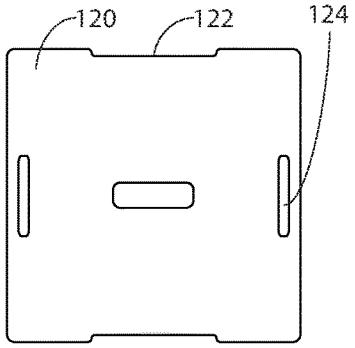
Figure 12E:
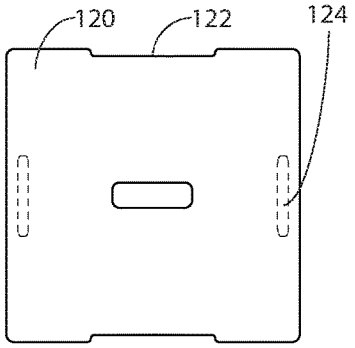
Figure 12F:
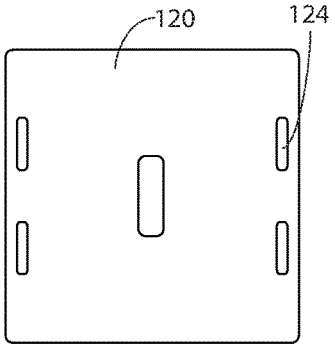

FIGS. 12*a* through 12*f* show different variations of the lid 120. FIG. 12*a* shows a lid 120 with only two recesses 122, which would fit on a crate where only two of the four sides 110 have tabs 111. FIG. 12*b* shows a lid 120 with two partial depth recesses 122, which would fit on a crate where the tabs 111 are partial height. FIG. 12*c* shows a lid 120 where the recesses 122 have two levels of depth, designed to fit on a crate where the tabs 111 have two levels of height (see FIG. 13*aa*). FIG. 12*d* shows a lid 120 where two of the recesses 122 have been replaced with slots 124 placed a short distance inside the outer edge. Such a design would allow the edges of the lid 120 to overhang the crate and would fit on the crate found in FIG. 18*b*. FIG. 12*e* shows a lid 120 where two of the recesses 122 have been replaced with partial depth slots 124 placed a short distance inside the outer edge. Such a design would fit on the crate found in FIG. 18*b*. FIG. 12*f* shows a lid 120 where instead of recesses 122, there are double slots 124 placed a short distance inside the outer edge, designed to fit on the crate found in FIG. 13*b*.

Figure 13A:
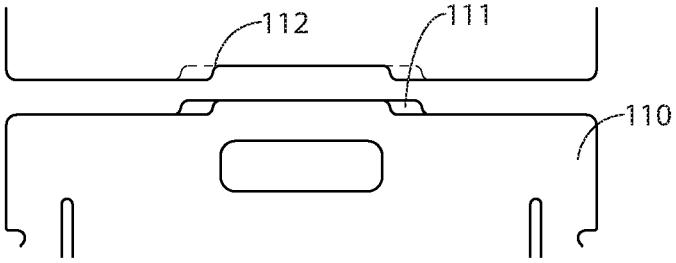
FIGS. 13*aa* through 14*b* show crate side panels.
Figure 13A:
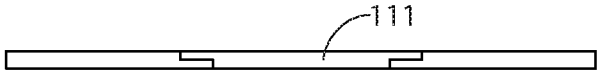

FIG. 13*aa* is another embodiment of tab 111, where the tab has two levels of height. Such a design would allow two tabs to prevent forwards/backwards, sideways, and twisting movement of the upper crate independent of the lower crate. Such a tab could only be cut out with a CNC router, not CNC laser or CNC waterjet. The stacking crates could be secured with only two tabs instead of four tabs. FIG. 13*ab* is a top view of the tab embodiment found in 13*aa*.

Figure 13B:
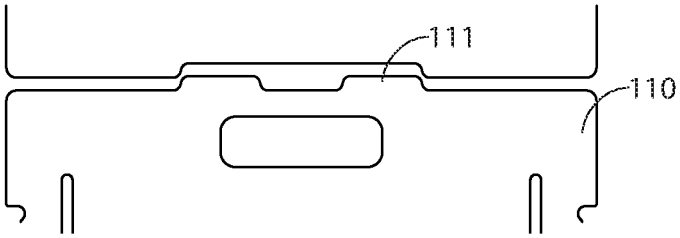

FIG. 13*b* is another embodiment of tab 111, where there are two distinct tabs a short distance apart. The bottom indention 112 would not need to have two recesses in order to fit over it.

Figure 14A:
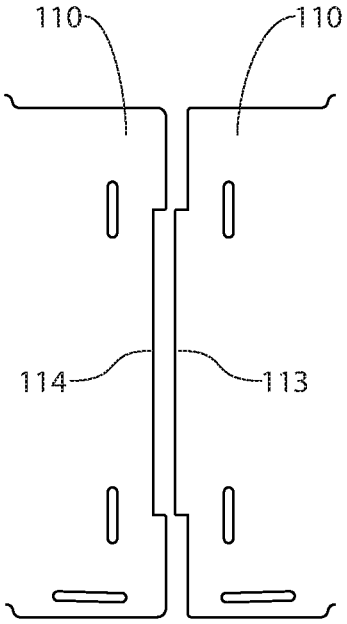
Figure 14B:
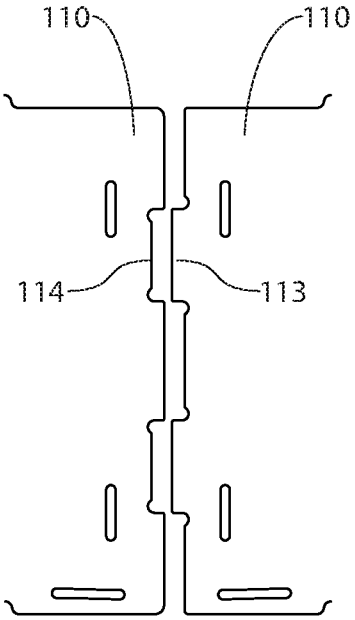

FIG. 14*a* is another embodiment of box joint 150, where the sides 110 are cut with a CNC laser or CNC waterjet. These tools don't require a round-out, making a tight ninety degree turn in the corners of the tab 113 and recess 114. FIG. 14*b* is another embodiment of box joint 150, where there are more tabs and recesses to the box joint. This could potentially prevent flexing.

Figure 15A:
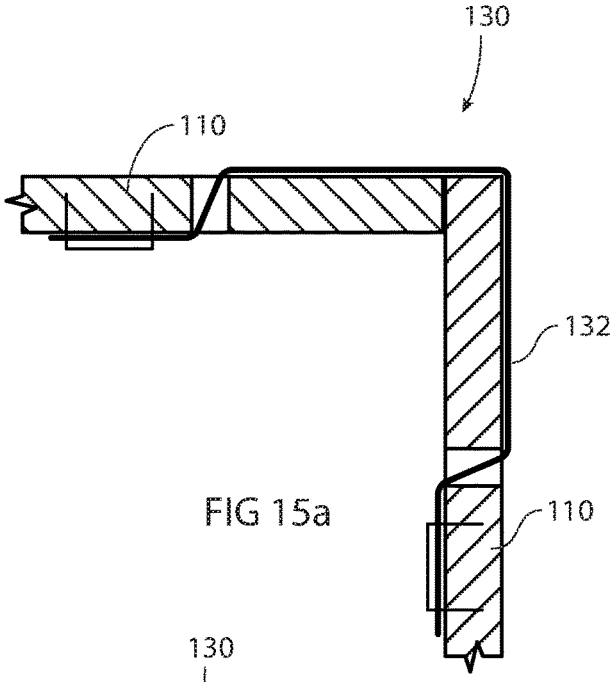
FIGS. 15*a* through 16 show the strap joint and pin.
Figure 15B:
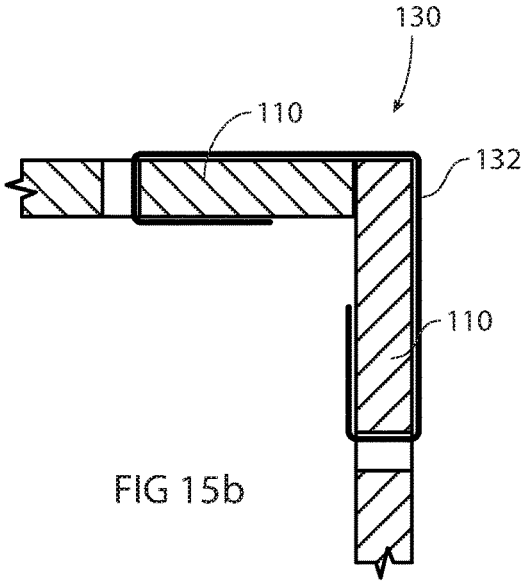
Figure 15C:
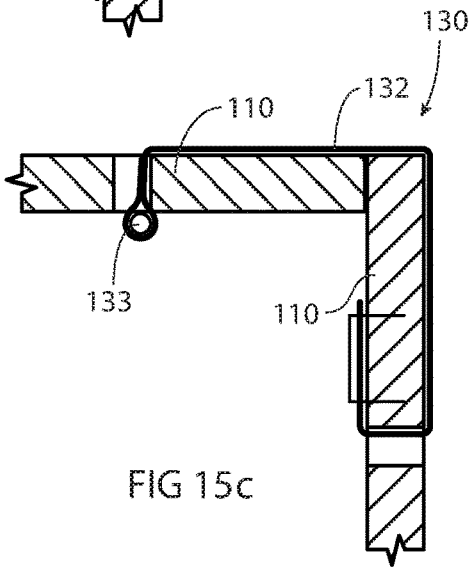
Figure 16:
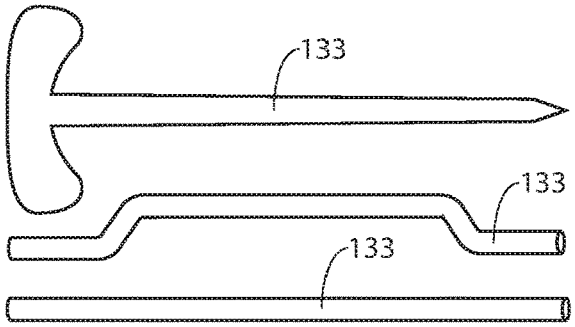

FIGS. 15*a* through 15*d* show the strap joint 130. FIG. 15*a* is another embodiment of strap joint 130, where the ends of strap 132 are folded out away from the edge of their respective side 110 before being fastened with staples. FIG. 15*b* is another embodiment of strap joint 130, where the ends of strap 132 are fastened with glue. FIG. 15*c* is another embodiment of strap joint 130, where the sides 110 are not permanently bound to each other via strap 132. One end of the strap 132 is folded back and fastened to itself, leaving a small loop wherein a dowel or pin 133 is threaded. This dowel or pin is longer than the height of slot 135. When the sides are parallel to each other, the strap 132 is loose, and the dowel or pin can be easily removed. When the sides are bent ninety degrees to each other, forming box joint 150, strap 132 stretches and pulls the dowel or pin tight against the edges of slot 135. FIG. 16 shows some examples of the various types of dowels 133 or pins 133 which could be used to hold the end of strap 132 in place per FIG. 15*d*.

Figure 17A:
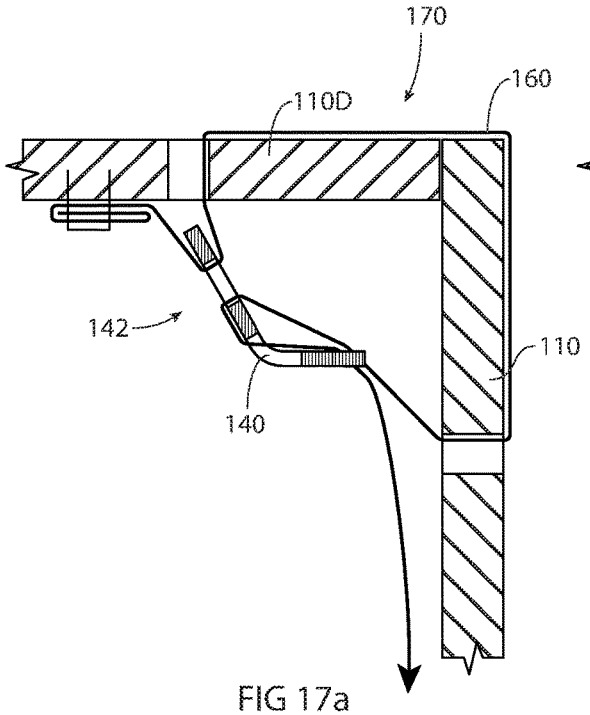
FIGS. 17*a* through 17*d* show the adjustable binding clamp.
Figure 17B:
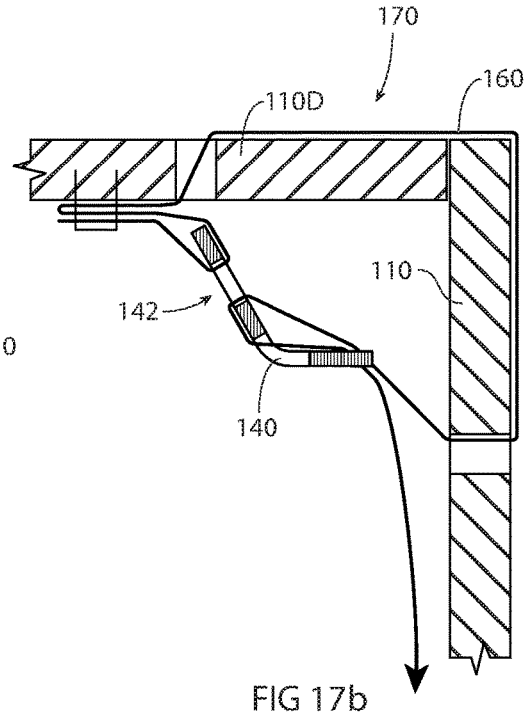
Figure 17C:
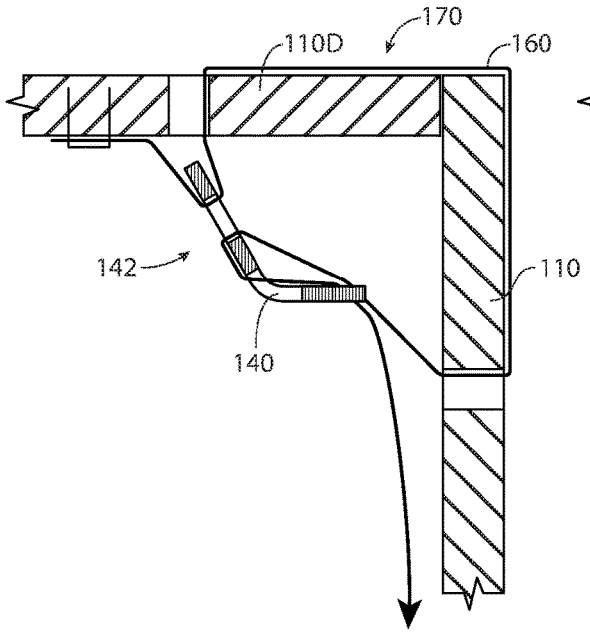
Figure 17D:
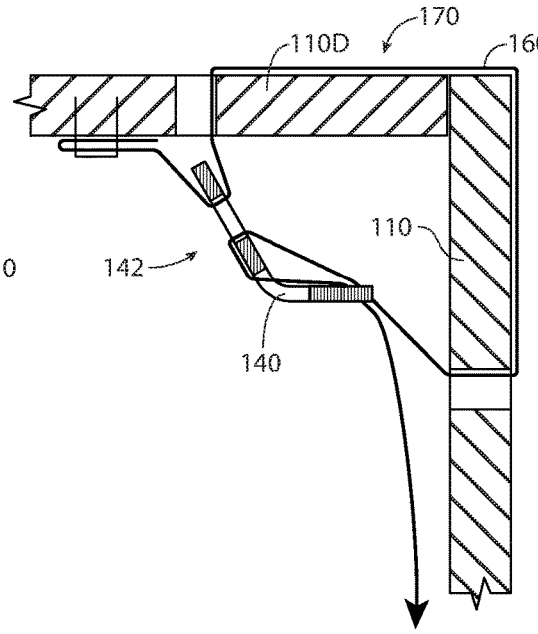

FIGS. 17*a* through 17*d* show the adjustable binding clamp 170. FIG. 17*a* shows an adjustable binding clamp 170 where the folds of strap 160 are fastened to side 110D before being threaded through slot 142 of buckle 140. FIG. 17*b* shows an adjustable binding clamp 170. A different arrangement of folds of strap 160 as it threads through slot 142 of buckle 140 while being fastened to side 110D. FIG. 17*c* shows an adjustable binding clamp 170. The strap 160 is simply fastened to side 110D without any folds before being threaded through slot 142 of buckle 140. FIG. 17*d* shows an adjustable binding clamp 170. The strap 160 is folded once before being fastened to side 110D, and then threaded through slot 142 of buckle 140.

Figure 18:
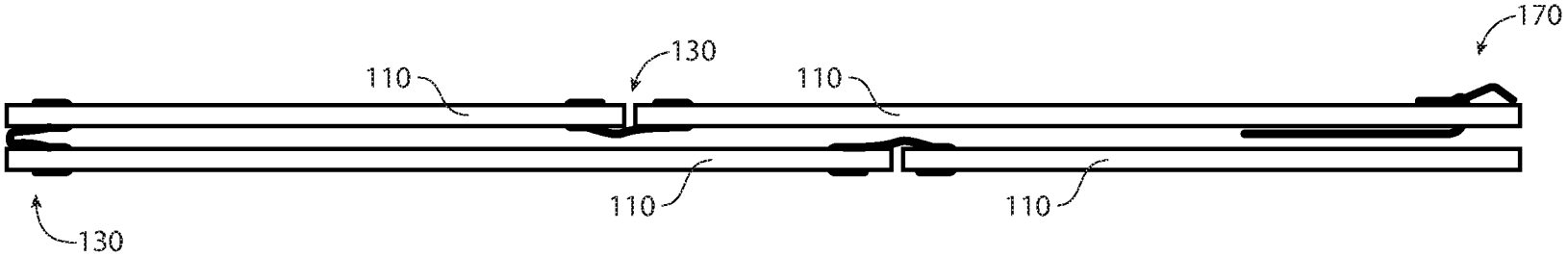
FIGS. 18 and 19 show collapsed crates.
Figure 19:
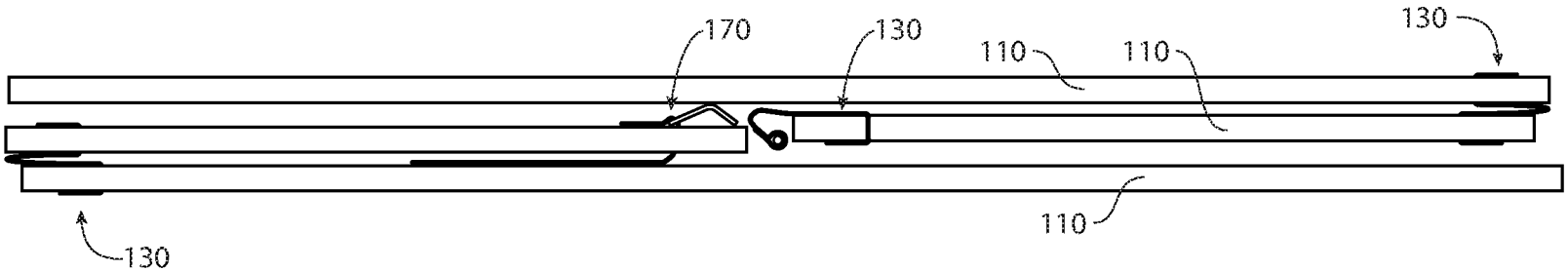

FIG. 18 shows the side view of the crate 100 when disassembled and packed flat where the side panels 110 are of two different lengths in this embodiment, the depicted orientation is the most compact way to store the crate. FIG. 19 shows the side view of the crate 100 when disassembled and packed flat where the strap binding 132 opposite the adjustable binding clamp is the embodiment found in FIG. 15*d*, the pin can be removed, and the parts can be packed flat in the more compact orientation depicted.

Figure 20A:
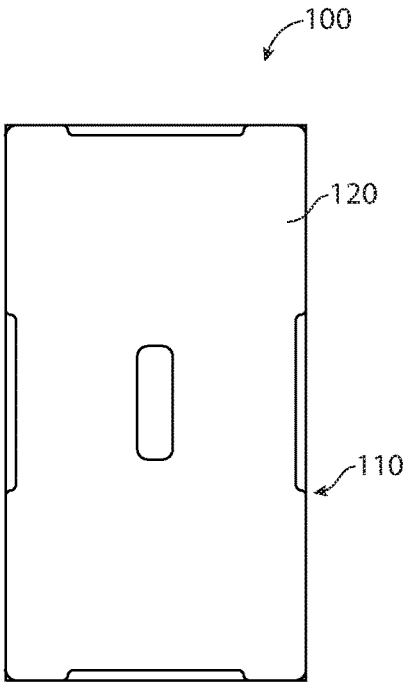
FIGS. 20*a* through 20*c* show a crate of modified proportions.
Figure 20B:
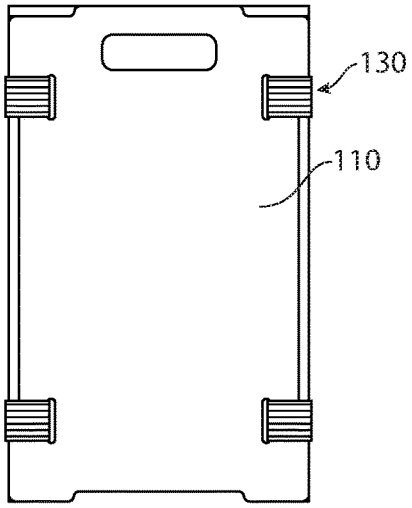
Figure 20C:
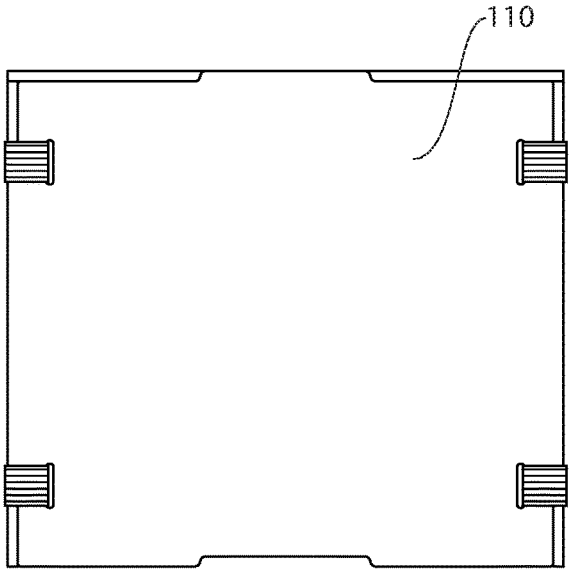

FIG. 20*a* shows another embodiment of crate 100. A top view of the crate shows that it is thinner and longer, making it more appropriate to fit under a desk, and hold papers and other flat objects. FIG. 20*b* shows the front view of this embodiment of crate 100. This crate is taller, making it more appropriate to fit under a desk, and hold papers and other flat objects. FIG. 20*c* shows the side view of this embodiment of crate 100. There are many different potential embodiments of crate 100, all different sizes and proportions, depending on the desired storage. To allow the crate to pack flat in a more compact orientation, the strap bindings 130 opposite the strap tensioner bindings 170 could be of the embodiment shown in FIG. 15*d*.

FIGS. 21*a* through 22*e* show how the basic construction of the crate 100 may be modified to create other items of furniture such as a dresser, desk, shelf, table, etc. It will be appreciated that all aspects of the joints discussed herein apply to each of the different items of furniture shown herein, as each uses the same basic construction and the same basic joints and each modifies the relative dimensions and orientation of the basic panels to create different articles of furniture.

Figure 21A:
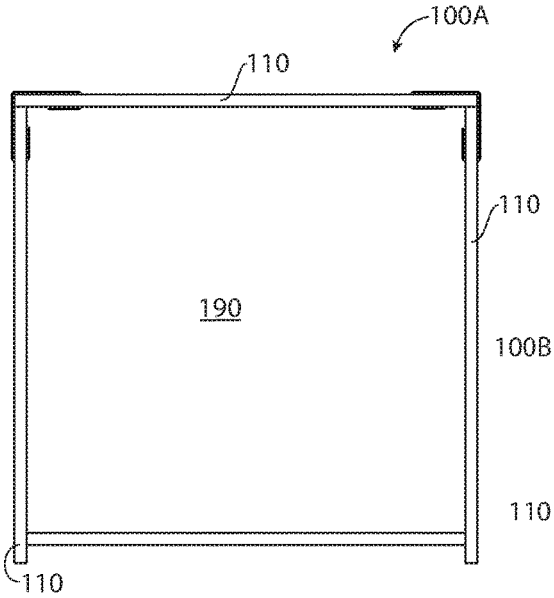

FIG. 21*a* shows another application of the box joint 150 and strap joint 130 in making a furniture cabinet 100A. Large side panels of a desk, chest of drawers, hutch, or other piece of furniture could be fastened to the top panel of the piece of furniture through the use of such a strap joint 130 with straps 132. The bottom edges of the side panels could be fastened together using strap joints 130, adjustable binding clamps 170, tab and slot joints, etc. A drawer could also be made in this configuration where the strap box joints are used on the front, and the back panel is bound with other means. The assembly shown is similar to a crate which is placed on its side. Accordingly, the top and side panels of the back panel of the furniture cabinet resemble the crate sides 110 and the back panel of the furniture cabinet resembles the crate bottom 190 and can be attached to the panels 110 with tabs on the panel 190 and slots in the panels 110.

Figure 21B:
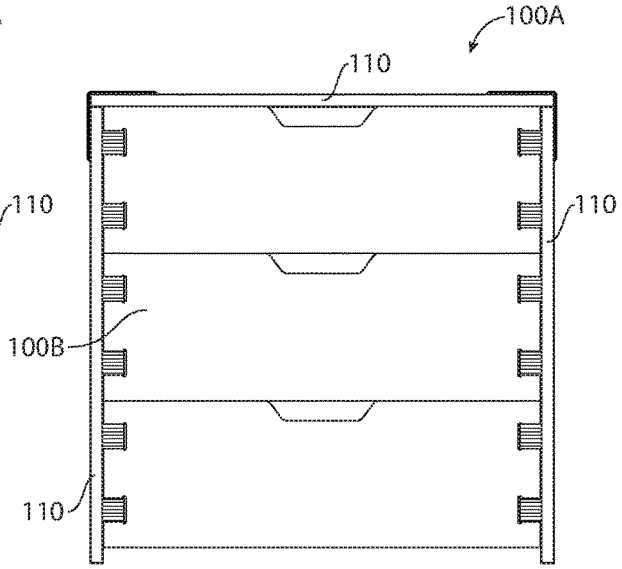

FIG. 21*b* shows the furniture cabinet 100A of FIG. 21*a* having drawers 100B. The cabinet 100A may be formed with internal horizontal partitions (see FIG. 22*d*) which support the drawers 100B. These internal partitions may each have tabs on their ends which insert into slots in the panels 110 to lock in as the side panels 110 and top panels 110 are assembled together with the back panel 190. The drawers 100B may be supported on these horizontal partitions.

Figure 21C:
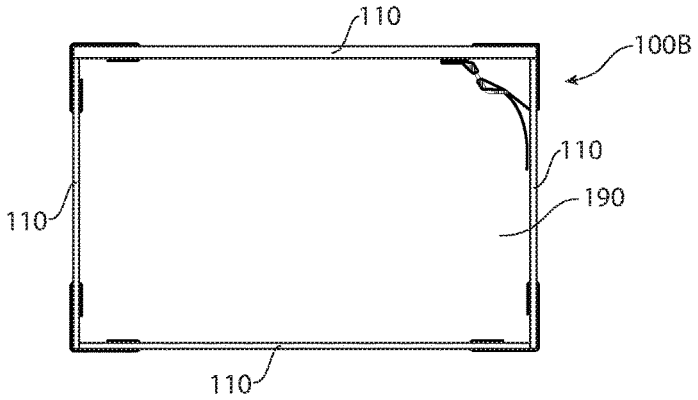

FIG. 21*c* shows the top view of the application of the strap joint 130 and adjustable binding clamp 170 to a large, shallow box, such as a drawer 100B as shown in FIG. 21*b*. The drawer 100B is similar to the crate 100 discussed and largely varies in its dimensions only. The drawer may be wider in its horizontal dimensions and less deep than a crate and may lack a lid. The drawer 100B is otherwise assembled with panels 110 and a bottom panel 190. If it is desired to have a front panel 110 of the drawer be thicker than the other panels, the amount of strap 132 in the strap joints 130 connecting the front panel may be increased. It is thus seen how the same basic construction of the crate 100 can be applied to furniture cabinets and drawers.

FIG. 22*a* shows a table such as a coffee table made in a similar fashion. The table may include a furniture cabinet 100A which uses strap joints 130 to attach panels 110 and, if desired, a back panel 190. The table may include drawers 100B.

Figure 22E:
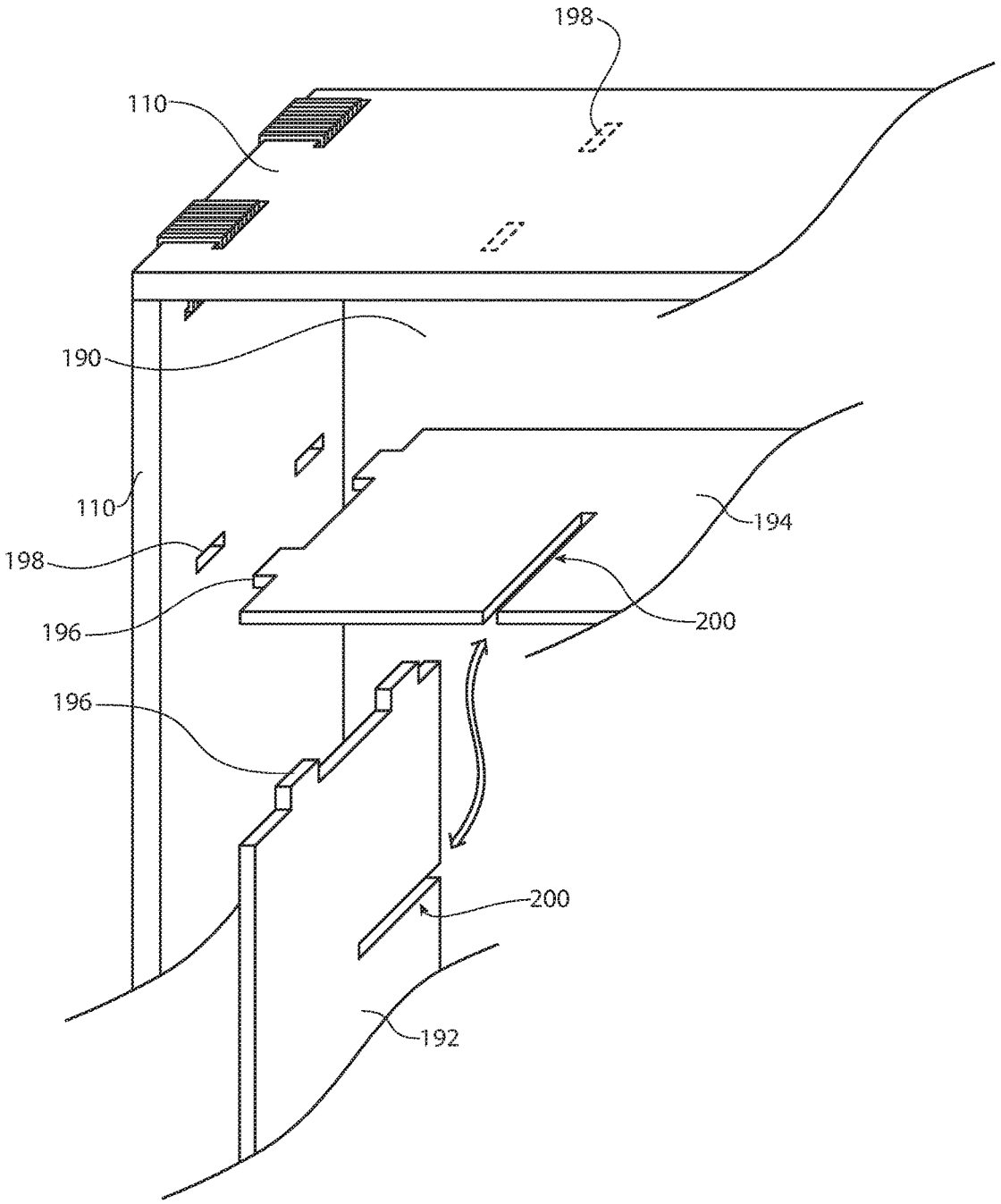

FIG. 22*b* shows a storage cabinet such as a hutch, shelving unit, or shoe bench made with the strap joints 130. The hutch may include a cabinet 100A which is formed with panels 110, a back panel 190, and with vertical divider panels 192 and horizontal divider panels 194. The vertical panels 192 and horizontal panels 194 in a storage grid may each have a through slot which extends halfway into the panel from an edge so that the vertical panels and horizontal panels intersect each other and form the storage grid. The ends of the vertical panels 192 and horizontal panels 194 may have tabs which intersect slots on the panels 110 to capture these panels 192, 194 as the panels 110 are assembled. See FIG. 22*e*.

FIG. 22*c* shows a desk made with strap joints 130. The desk includes a cabinet 100A made with panels 110 and a back panel 190, and with additional vertical panels 192 and horizontal panels 194 assembled as discussed with respect to FIG. 21*b*. The desk may also have drawers 100B.

FIG. 22*d* shows a bookcase made with the strap joints 130. The bookcase may include a cabinet 100A made with panels 110, a back panel 190, and horizontal dividers 194.

FIG. 22*e* shows how vertical panels 192 and horizontal panels 194 may have tabs 196 which engage slots 198 in the panels 110 to attach these panels 192, 194 to the furniture cabinet 100 similar to how the base panel 190 is attached to the panels 110. The panels 192, 194 may have elongate slots 200 which allow them to intersect each other to form a storage grid.

In discussing the items of furniture, the reference numbers of the panels and parts have been used according to the functionality of the parts and not the strict location of the parts. Thus, the base panel 190 of the crate performs the function of the back panel 190 in a cabinet or base panel 190 in a drawer and is attached to panels 110 in like manner. Similarly, panels 110, even though positioned horizontally or vertically, include strap joints and are assembled in like manner.

The above description of illustrated examples of the present invention, including what is described in the Abstract, are not intended to be exhaustive or to be limitation to the precise forms disclosed. While specific examples of the invention are described herein for illustrative purposes, various equivalent modifications are possible without departing from the broader scope of the present claims. Indeed, it is appreciated that specific example dimensions, materials, etc., are provided for explanation purposes and that other values may also be employed in other examples in accordance with the teachings of the present invention.

What is claimed is:

1. A piece of furniture comprising:

a first rigid panel;

a second rigid panel;

a tab extending from a first edge of the first panel;

a recess formed in a first edge of the second panel which has a width which is substantially equal to a width of the tab;

a first strap of resilient material which is attached to the first panel and to the second panel;

wherein the first edge of the first panel is disposed adjacent the first edge of the second panel to form a corner joint;

wherein the first panel is disposed generally perpendicular to the second panel;

wherein the tab is disposed in the recess;

wherein the first strap extends around the outside of the corner joint between a first location on the first panel and a second location on the second panel such that the first strap extends from the first location on the first panel, along an outside surface of the first panel, around the outside of the corner joint, along an outside surface of the second panel, and to the second location on the second panel without passing between the first panel and the second panel to the inside of the corner joint; and wherein the first strap is stretched and maintained in tension when the joint is assembled.

2. The piece of furniture of claim 1, further comprising a slot formed in the first panel and a slot formed in the second panel; and wherein the first strap is attached to an inside face of the first panel, passes through the slot in first panel, extends around the corner joint on the outside of the first panel and second panel, passes through the slot in the second panel, and is attached to an inside face of the second panel.

3. The piece of furniture of claim 1, wherein the width of the tab and the width of the recess are less than a width of the first strap;

wherein the first strap is disposed to cover a first lateral edge of the tab and an adjacent first lateral edge of the recess; and wherein the first strap is also disposed to cover a second lateral edge of the tab and an adjacent second lateral edge of the recess disposed opposite the first lateral edge of the tab and the first lateral edge of the recess.

4. The piece of furniture of claim 1, wherein the first strap is releasably attached to the first panel and may be released from the first panel to remove the first panel from the second panel.

5. The piece of furniture of claim 4, further comprising a slot formed in the first panel, and wherein a first end of the strap comprises an opening, wherein the first end of the strap passes through the slot, and further comprising a locking member which passes through the opening and prevents the first end of the strap from withdrawing through the slot when the corner joint is assembled.

6. The piece of furniture of claim 1, wherein the piece of furniture comprises four panels;

wherein edges of the four panels are placed adjacent each other so that the four panels form a rectangular box;

wherein, at each of three corners of the rectangular box, two adjacent panels engage each other to prevent relative movement between the two adjacent panels along the corner and are connected to each other by a strap which is attached to the two adjacent panels;

wherein a section of the strap extends along an outside surface of a first panel of the two adjacent panels, around the outside of the corner, and along an outside surface of a second panel of the two adjacent panels without passing between the two adjacent panels to the inside of the corner; and wherein, at a fourth corner of the rectangular box, two adjacent panels are connected to each other by an adjustable binding clamp comprising a strap and a buckle.

7. The piece of furniture of claim 6, wherein the releasable binding clamp strap passes through slots in the two panels adjacent to the fourth corner and attaches to the buckle so that the binding clamp strap forms a loop which extends through a slot, around the outside of the fourth corner, through another slot, and across the inside of the fourth corner.

8. The piece of furniture of claim 6, further comprising a fifth panel, wherein the fifth panel has tabs formed on edges thereof, wherein the tabs are held in corresponding slots in the four panels so that the fifth panel is held captive between the four panels.

9. A piece of furniture comprising:

a first rigid panel;

a second rigid panel;

a tab extending from a first edge of the first panel;

a recess formed in a first edge of the second panel which has a width which is substantially equal to a width of the tab;

a first strap of resilient material which is attached to the first panel and to the second panel;

wherein the first edge of the first panel is disposed adjacent the first edge of the second panel to form a corner joint;

wherein the first panel is disposed generally perpendicular to the second panel;

wherein the tab is disposed in the recess;

wherein the first strap extends around the outside of the corner joint between the first panel and the second panel such that the first strap extends around the adjacent first edge of the first panel and the first edge of the second panel; and wherein the first strap is stretched and maintained in tension when the joint is assembled; and wherein the tab comprises a tab lateral edge and the recess comprises a recess lateral edge disposed adjacent the tab lateral edge, and wherein the first strap is disposed over the tab lateral edge and the recess lateral edge to cover the tab lateral edge and the recess lateral edge on the outside of the joint.

10. The piece of furniture of claim 9, further comprising a second strap of resilient material which is attached to the first panel and to the second panel;

wherein the second strap extends around the outside of the corner joint between the first panel and the second panel such that the second strap extends around the adjacent first edge of the first panel and the first edge of the second panel;

wherein the second strap is stretched and maintained in tension when the joint is assembled;

wherein the first strap is disposed to cover a first lateral edge of the tab and an adjacent first lateral edge of the recess; and wherein the second strap is disposed to cover a second lateral edge of the tab and an adjacent second lateral edge of the recess.

11. A piece of furniture comprising:

a first rigid panel having a first edge;

a second rigid panel having a first edge;

wherein the first edge of the first panel is disposed adjacent the first edge of the second panel to form a corner joint;

wherein the first panel engages the second panel to prevent relative movement between the first panel and second panel along the corner joint;

a strap which is attached to the first panel and to the second panel;

wherein the strap extends around the outside of the corner joint between a first location on the first panel and a second location on the second panel such that the strap extends from the first location, along an outer surface of the first panel, around the outside of the corner joint, along an outer surface of the second panel, and to the second location without passing to the inside of the corner joint; and wherein the strap is stretched and maintained in tension when the joint is assembled to hold the first panel and second panel together.

12. The piece of furniture of claim 11, further comprising:

a tab formed on a first edge of the first panel;

a recess formed in a first edge of the second panel which has a width which is substantially equal to a width of the tab;

wherein the tab is disposed in the recess to prevent relative movement between the first panel and the second panel along the corner joint.

13. The piece of furniture of claim 12, wherein the tab comprises a tab lateral edge and the recess comprises a recess lateral edge, and wherein the strap is disposed over the tab lateral edge and the recess lateral edge to cover the tab lateral edge and the recess lateral edge on the outside of the joint.

14. The piece of furniture of claim 12, further comprising a slot formed in the first panel and a slot formed in the second panel; and wherein the strap is attached to an inside face of the first panel, passes through the slot in first panel, extends around the corner joint on the outside of the first panel and second panel, passes through the slot in the second panel, and is attached to an inside face of the second panel.

15. The piece of furniture of claim 11, wherein the strap is releasably attached to the first panel, and wherein a first end of the strap passes through a slot in the first panel, wherein a first end of the strap comprises an opening formed therein, and further comprising a locking member disposed in the opening adjacent an inside surface of the first panel to prevent the first end of the strap from passing through the opening when the corner joint is assembled.

16. The piece of furniture of claim 11, wherein the strap is releasably attached to the first panel, and wherein a first end of the strap is passed around the first panel, through an opening in the first panel, and is connected to a second end of the strap via a connector to thereby hold the first panel and the second panel together.

17. The piece of furniture of claim 11, wherein the piece of furniture comprises four panels;

wherein edges of the four panels are placed adjacent each other so that the four panels form a rectangular box;

wherein, at each of three corners of the rectangular box, two adjacent panels engage each other to prevent relative movement between the two adjacent panels along the corner and are connected to each other by a strap which is attached to the two adjacent panels;

wherein a section of the strap extends along an outside surface of a first panel of the two adjacent panels, around the outside of the corner, and along an outside surface of a second panel of the two adjacent panels without passing between the two adjacent panels to the inside of the corner; and wherein, at a fourth corner of the rectangular box, two adjacent panels are connected to each other by an adjustable binding clamp comprising a strap and a buckle.

18. The piece of furniture of claim 17, wherein the releasable binding clamp strap passes through slots in the two panels adjacent to the fourth corner and attaches to the buckle so that the binding clamp strap forms a loop which extends through a slot, around the outside of the fourth corner, through another slot, and across the inside of the fourth corner.

19. The piece of furniture of claim 12, further comprising a second strap which is attached to the first panel and to the second panel;

wherein the second strap extends around the outside of the first panel, around the outside of the corner joint, and around the outside of the second panel;

wherein the second strap is stretched and maintained in tension when the joint is assembled;

wherein the strap is disposed to cover a first lateral edge of the tab and an adjacent first lateral edge of the recess; and wherein the second strap is disposed to cover a second lateral edge of the tab and an adjacent second lateral edge of the recess.

20. The piece of furniture of claim 12, wherein a width of the tab and a width of the recess are less than a width of the strap;

wherein the strap is disposed to cover a first lateral edge of the tab and an adjacent first lateral edge of the recess and is also disposed to cover a second lateral edge of the tab and an adjacent second lateral edge of the recess which are disposed opposite the first lateral edge of the tab and the first lateral edge of the recess.

* * * * *